US010520864B2

(12) United States Patent
Taguchi et al.

(10) Patent No.: US 10,520,864 B2
(45) Date of Patent: Dec. 31, 2019

(54) IMAGE FORMING APPARATUS THAT CONTROLS A TARGET TEMPERATURE OF A HEATING MEMBER BASED ON WHETHER PIXELS FOR FORMING AN IMAGE ARE A PREDETERMINED DENSITY OR MORE

(71) Applicant: CANON KABUSHIKI KAISHA, Tokyo (JP)

(72) Inventors: Sho Taguchi, Fujisawa (JP); Masashi Tanaka, Kawasaki (JP); Tatsuya Kinukawa, Kawasaki (JP); Naofumi Murata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/150,734

(22) Filed: Oct. 3, 2018

(65) Prior Publication Data

US 2019/0101854 A1 Apr. 4, 2019

(30) Foreign Application Priority Data

Oct. 4, 2017 (JP) ..... 2017-194103
Jul. 5, 2018 (JP) ..... 2018-127991

(51) Int. Cl.
*G03G 15/00* (2006.01)
*G03G 15/20* (2006.01)
*G03G 15/04* (2006.01)

(52) U.S. Cl.
CPC ..... *G03G 15/2039* (2013.01); *G03G 15/2028* (2013.01); *G03G 15/55* (2013.01); *G03G 15/04072* (2013.01)

(58) Field of Classification Search
CPC ..... G03G 15/2028; G03G 15/2039; G03G 15/55; G03G 15/04072
See application file for complete search history.

(56) References Cited

U.S. PATENT DOCUMENTS

2013/0045021 A1* 2/2013 Yoshioka ..... G03G 15/2039 399/69
2014/0072321 A1* 3/2014 Ooyanagi ..... G03G 15/2039 399/69

(Continued)

FOREIGN PATENT DOCUMENTS

JP S63-313182 A 12/1988
JP 2001-083836 A 3/2001

(Continued)

*Primary Examiner* — Sophia S Chen
(74) *Attorney, Agent, or Firm* — Venable LLP

(57) ABSTRACT

An image forming apparatus includes an image forming portion that forms an image on a recording material, and a fixing portion including a cylindrical heat transfer member, and a heating member contacting an inner surface of the heat transfer member. The fixing portion fixes the image on the recording material by heating the recording material, on which the image has been formed, by heat from the heating member through the heat transfer member. A control unit controls a target temperature of the heating member, and analyzes whether or not a plurality of pixels, of image data corresponding to the image to be formed on the recording material, in each interval corresponding to a circumferential length of the heat transfer member, with respect to a recording material feeding direction, are pixels for forming an image with a predetermined density or more, and sets the target temperature depending on an analyzation result.

17 Claims, 11 Drawing Sheets

(56) References Cited

U.S. PATENT DOCUMENTS

| | | | | |
|---|---|---|---|---|
| 2016/0004195 | A1 | 1/2016 | Ozawa et al. | |
| 2018/0348667 | A1* | 12/2018 | Omata | G03G 15/2039 |

FOREIGN PATENT DOCUMENTS

| | | | |
|---|---|---|---|
| JP | 2003-233260 | A | 8/2003 |
| JP | 2016-004231 | A | 1/2016 |
| JP | 2016-014728 | A | 1/2016 |

* cited by examiner

IMAGE FORMING APPARATUS THAT CONTROLS A TARGET TEMPERATURE OF A HEATING MEMBER BASED ON WHETHER PIXELS FOR FORMING AN IMAGE ARE A PREDETERMINED DENSITY OR MORE

This application claims the benefit of Japanese Patent Application No. 2017-194103, filed Oct. 4, 2017, and Japanese Patent Application No. 2018-127991, filed on Jul. 5, 2018, which are hereby incorporated by reference herein in their entireties.

FIELD OF THE INVENTION AND RELATED ART

The present invention relates to an image forming apparatus, such as an electrophotographic copying machine, or an electrophotographic printer.

The electrophotographic machine or printer includes an image forming portion for forming an image on a recording material, and a fixing portion (fixing device) for fixing the image on the recording material. As the fixing device, a fixing device of a film fixing type has been known. Japanese Laid-Open Patent Application No. Sho 63-313182 discloses the fixing device of this type.

The fixing device of the film fixing type includes a heater including a heat generating resistor for generating heat by energization, a cylindrical film rotating in contact with an inner peripheral surface of the heater, and a pressing roller for forming a nip in cooperation with the heater through the film. The recording material, on which an unfixed toner image is formed by the image forming portion, is fed and heated in the nip, so that the toner image is fixed on the recording material.

In the fixing device of a film heating type, a thermal capacity of the film is small, and, therefore, when the recording material, on which an image pattern with a high print ratio is formed passes through the nip, heat of the film is taken by the image pattern, so that a lowering in film transfer material generates.

Accordingly, a fixing property of the image pattern on a recording material trailing end side lowers in a case in which a length of the image pattern with the high print ratio with respect to a recording material feeding direction is greater than a circumferential length of the film, or in a case in which the image pattern with the high print ratio is repeated in conformity to a rotation period of the film. Further, when the recording material passes through the nip, heat of the film is taken by the recording material and, therefore, a film transfer material lowers, so that the film transfer material lowers with a decreasing distance to a trailing end of the recording material and thus, the fixing property of the toner image lowers.

Further, as regards the pressing roller, in order to shorten a wait time (quick start property: on-demand actuation) or to save electrical power, in a case in which a thermal capacity of an elastic layer is decreased, a fixing temperature for a second side of the recording material, during double-sided printing, is affected by a toner amount per unit area on a first side of the recording material. For that reason, when the toner amount per unit area on the first side of the recording material is large, thermal capacity of the toner is added to thermal capacity of paper (recording material), and therefore, there was a need to increase a fixing transfer material for the second side of the recording material.

Further, in a case in which the length of the image pattern with the high print ratio on a first side of a recording material with respect to the recording material feeding direction is longer than a region roller circumferential length, or in a case in which the image pattern with the high print ratio is repeated in conformity to the rotation period of the pressing roller, a pressing roller temperature on a recording material trailing end side lowered in some instances.

Conventionally, a technique such that a fixing temperature of the fixing device is controlled depending on an amount per unit area acquired from the image data has been known. Japanese Laid-Open Patent Application No. 2016-004231 discloses a method in which, in a case in which input image data is subjected to image interlaced process and, thereafter, a maximum toner amount of dots in a page is discriminated, and then, an image with a large toner amount per unit area is formed, the fixing temperature of the fixing device is made greater than the fixing temperature in a case in which an image with a small toner amount per unit area.

In a conventional constitution disclosed in Japanese Laid-Open Patent Application No. 2016-004231, when the maximum toner amounts per unit area of dots in the page are the same, the fixing temperatures are the same. For that reason, when the fixing temperature is set so that an image pattern, which exists on the recording material trailing end side in which a fixing property lowers, and which is long with respect to the recording material feeding direction, can be sufficiently fixed, a set fixing temperature is highest, so that electrical power consumption becomes maximum. In the case of this setting, as regards another image pattern, which is printed only on a recording material leading end side and in which a maximum toner amount per unit area is the same as that of the image pattern on the recording material trailing end side, a lowering in film temperature does not occur and, therefore, the fixing temperature is the same as that of the image pattern on the recording material trailing end side, although the fixing property is good.

Accordingly, as regards the image pattern on the recording material leading end side, although the image pattern can be fixed even when electrical power consumption is suppressed, the fixing temperature is set at a high temperature and, therefore, useless energy is consumed, so that an energy saving property is impaired. On the other hand, when the fixing temperature is set at a low temperature in order to suppress the electrical power consumption, improper fixing generates in the image pattern on the recording material trailing end side.

SUMMARY OF THE INVENTION

According to one aspect, the present invention provides an image forming apparatus comprising an image forming portion configured to form an image on a recording material, a fixing portion including a cylindrical heat transfer member and a heating member contacting an inner surface of the heat transfer member, the fixing portion being configured to fix the image on the recording material by heating the image-formed recording material by heat from the heating member through the heat transfer member, and a control unit configured to control a target temperature of the heating member, wherein the control unit analyzes whether or not a plurality of pixels, of image data corresponding to the image to be formed on the recording material, in each interval corresponding to a circumferential length of the heat transfer member, with respect to a recording material feeding direction, are pixels for forming an image with a predetermined density or more, and sets the target temperature depending on an analyzation result.

Further features of the present invention will become apparent from the following description of exemplary embodiments with reference to the attached drawings.

DESCRIPTION OF EMBODIMENTS

Embodiments of the present invention will be described with reference to the drawings. Although these embodiments are preferred embodiments of the present invention, the present invention is not limited to the following embodiments, and can be replaced with other various constitutions within a scope of a concept of the present invention.

Embodiment 1

Figure 1:
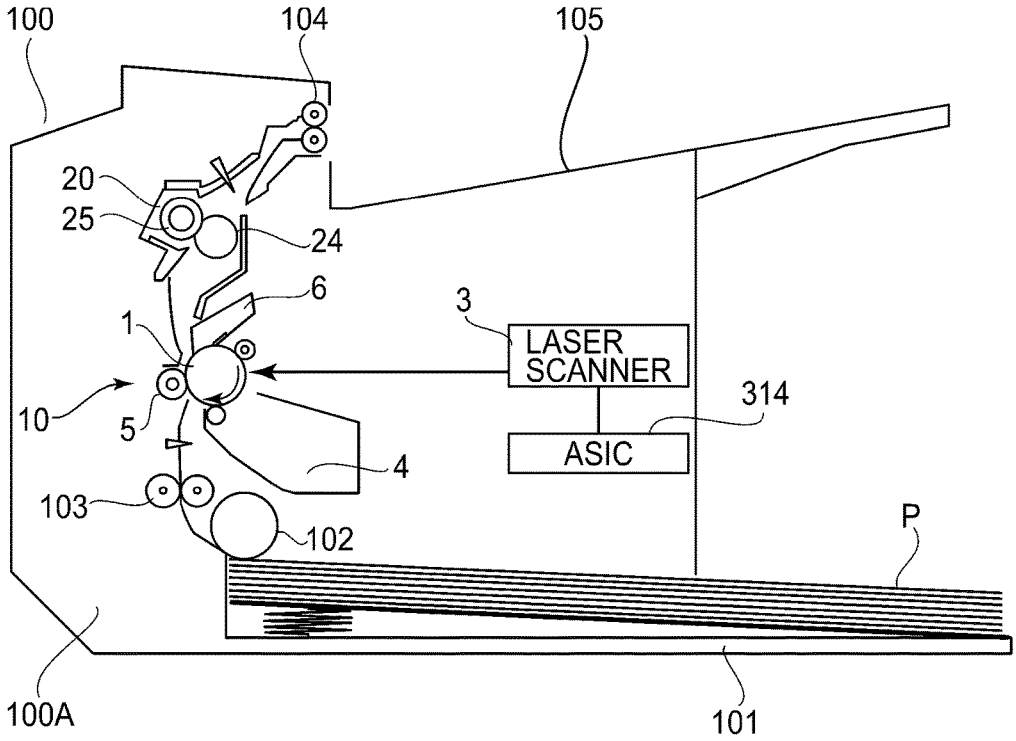
FIG. 1 is a sectional view showing a schematic structure of an image forming apparatus.

With reference to FIG. 1, an image forming apparatus according to this embodiment will be described. FIG. 1 is a sectional view showing a general structure of an example of the image forming apparatus (a monochromatic laser printer in this embodiment) 100 using an electrophotographic recording technique.

The image forming apparatus 100 includes an image forming portion 10 for forming an image on a recording material a fixing portion (hereafter referred to as a "fixing device") 20 for fixing the image on the recording material.

In the image forming portion 10, a drum-type electrophotographic photosensitive member (hereafter referred to as a "photosensitive drum") 1, as an image bearing member, is rotationally driven at a predetermined process speed (peripheral speed) in an arrow direction by a motor (not shown).

This photosensitive drum 1 is electrically charged uniformly to a predetermined polarity and a predetermined potential. On a charged surface of the photosensitive drum 1, an electrostatic latent image is formed by a laser beam emitted from a laser scanner (exposure means) 3. The laser scanner 3 carries out scanning exposure, which is ON/OFF-controlled depending on image information, and removes electrical charges of an exposed portion of the surface of the photosensitive drum 1, so that the electrostatic latent image is formed on the photosensitive drum surface. This electrostatic latent image is developed and visualized using toner by a developing device (developing means) 4.

Transfer materials P, as recording materials accommodated in a cassette 101 provided in an apparatus main assembly 100A, are fed one by one by rotation of a roller 102. The transfer material P is fed by rotation of a roller pair 103 to a transfer portion formed by the photosensitive drum 1 and a transfer image 5, and a toner image is transferred from the surface of the photosensitive drum 1 onto the transfer material P under application of a transfer bias to the transfer member 5 during feeding of the transfer material P. The transfer material P carrying an unfixed toner image thereon is sent to a fixing device 20, and the toner image is fixed on the transfer material P by the fixing device 20. The transfer material P coming out of the fixing device 20 is discharged onto a tray 105 by rotation of a roller pair 104.

The surface of the photosensitive drum 1 after the toner image transfer is cleaned by a cleaner 6.

The image forming apparatus 100 in this embodiment is an apparatus that is 600 dots per inch (dpi) in resolution, 30 sheets/min. in throughput (LTR long edge feeding, process speed of about 222 mm/s), and 100,000 sheets in durable lifetime.

Printer Control Device 304

Figure 2:
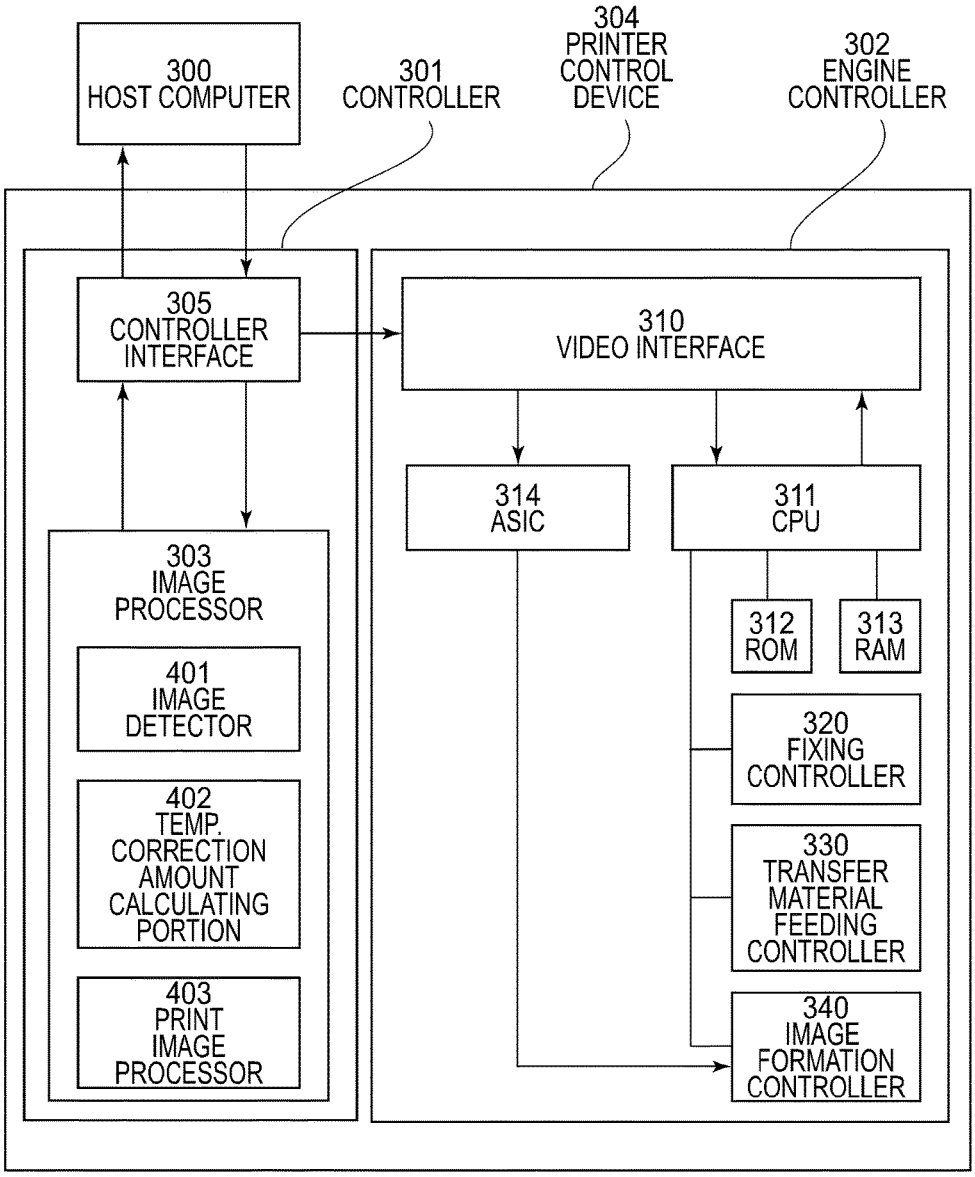
FIG. 2 is a block diagram showing a system constitution of a printer control device.

A printer control device 304, managing entire control of the image forming apparatus 100, will be described while making reference to FIG. 2. FIG. 2 is a block diagram for illustrating a system constitution of the printer control device 304.

The printer control device 304 is connected with a host computer 300 using a controller interface 305. This printer control device 304 is roughly divided into a controller (portion) 301 and an engine controller (portion) 302.

The controller 301 includes the controller interface 305 and an image processing portion 303.

The engine controller 302 includes a video interface 310, an application specific integrated circuit (ASIC) 314, a central processing unit (CPU) 311 as a control means, a read only memory (ROM) 312, and a random access memory (RAM) 313. The engine controller 302 further includes a fixing controller 320 as a fixing control means, a transfer material feeding controller 330, and an image formation controller 340.

In the controller 301, on the basis of information received from the host computer 300 via the interface 305, a print image processing portion 403 as a print image processing means of the image processing portion 303 performs bitmap processing of a character code. Further, in the controller 301, half-toning processing of a gray-scale image, or the like, is performed. Further, the image processing portion 303 sends image information to the interface 310 of the engine controller 302 via the interface 305.

The image information includes information for controlling ON-timing of the laser scanner 3, a print mode for controlling a process condition, such as a control temperature and a transfer bias, and image size information.

The ON-timing information of the laser scanner 3 is sent to the ASIC 314 via the interface 310. The ASIC 314 controls a part of the image forming portion, such as the laser scanner 3. On the other hand, the print mode and the image size information are sent to the CPU 311 via the interface 310.

The CPU 311 stores information in the RAM 313 as needed, uses a program stored in the ROM 312 or the RAM 313, and makes reference to information stored in the ROM 312 or the RAM 313. Further, on the basis of these pieces of the information, the CPU 311 causes the fixing controller 320 to carry out control of the control temperature of the fixing device 20 and causes the transfer material feeding controller 330 to carry out control of an operation interval of the roller 102. Further, the CPU 311 causes the image formation controller 340 to carry out control of the process speed and development/charging/transfer.

Further, the controller 301 sends, depending on instructions provided by a user through the computer 300, instruction information, such as a print instruction, a cancel instruction, or the like, to the interface 310 of the engine controller 302 via the interface 305. The instruction information is sent to the image formation controller 340 via the CPU 311, so that the image formation controller 340 carries out control of a start and a stop of a printing operation.

Fixing Device 20

Figure 3:
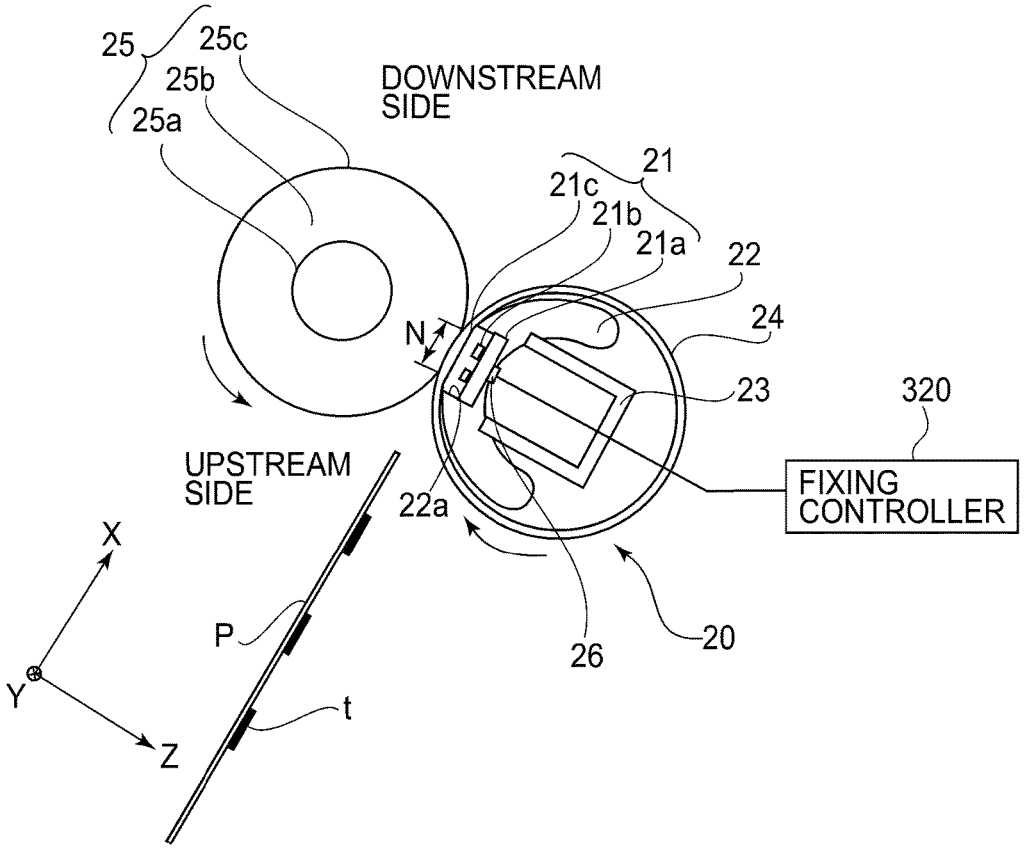
FIG. 3 is a sectional view showing a schematic structure of a fixing device.
Figure 4:
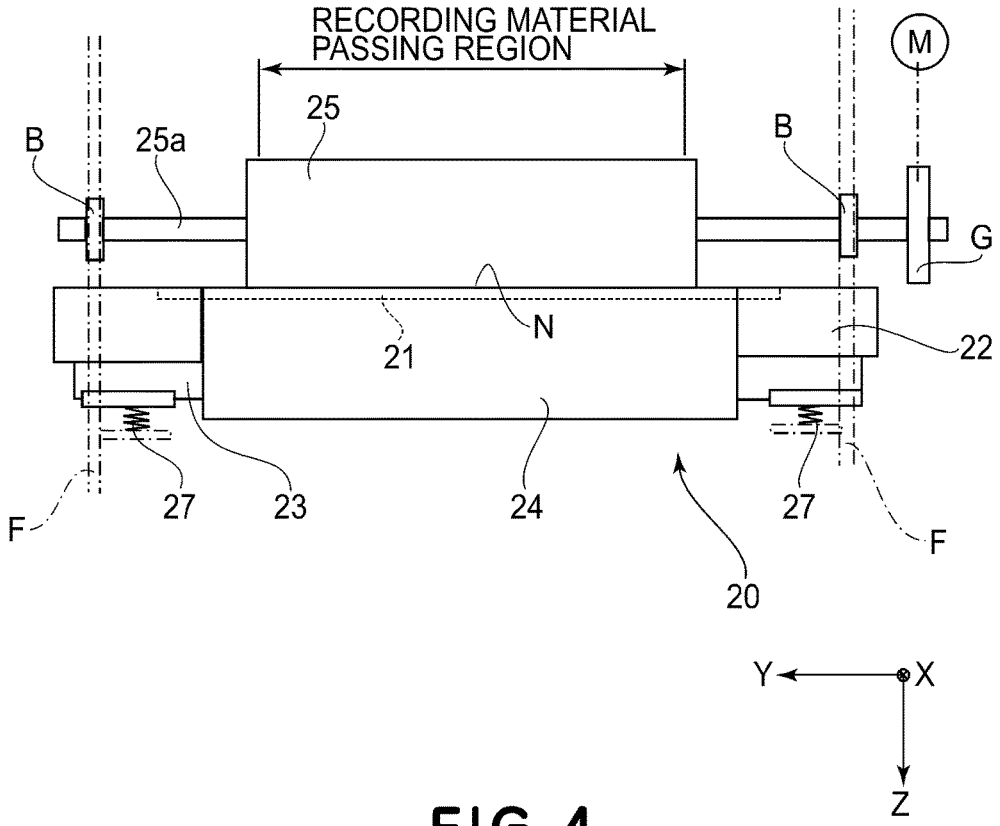
FIG. 4 is a schematic view of the fixing device as seen from an upstream side with respect to a recording material feeding direction.

A constitution of the fixing device 20 will be described while making reference to FIGS. 3 and 4. FIG. 3 is a sectional view showing a schematic structure of the fixing device 20. FIG. 4 is a schematic view of the fixing device 20 as seen from an upstream side of a recording material feeding direction X.

The fixing device 20 includes a ceramic heater 21 as a heating member, a holder 22 as a supporting member for supporting the heater 21, and a stay 23 for pressing the holder 22. The fixing device 20 further includes a film 24 as a cylindrical heat transfer member and a pressing roller 25 as a pressing member for forming a nip N in cooperation with the heater 21 through the film 24.

Film 24

The film 24 is a composite layer film in which a parting layer is formed on an outer peripheral surface of a thin bare metal pipe of stainless steel (SUS), or the like, or an outer peripheral surface of a base layer in which a kneaded mixture of a heat-resistant resin material, such as polyimide, and a heat transfer filler is molded in a cylindrical shape. The parting layer is formed on the surface of the base layer directly or through a primer layer by coating or tube coating with tetrafluoroethylene perfluoroalkylvinyl ether copolymer (PFA), polytetrafluoroethylene (PTFE), tetrafluoroethylene hexafluoropropylene copolymer (FEP), or the like.

In this embodiment, as the base layer of the film 24, a layer of polyimide coated with PFA was used. A total thickness of the film 24 is 70 μm, and an outer circumferential length of the film 24 is 56 mm.

The film 24 rotates while an inner peripheral surface thereof slides (contacts) with the heater 21 and the holder 22, which are inserted in a hollow portion of the film 24, and, therefore, there is a need to suppress a friction resistance between the heater 21 and the film inner surface and a friction resistance between the holder 22 and the film inner surface to small values. For this reason, a lubricant, such as heat-resistant grease, is applied onto the surfaces of the heater 21 and the holder 22 with which the inner surface of the film 24 slides. As a result, the film 24 can rotate smoothly.

Holder 22

The holder 22 supports the heater 21 by a groove 22*a* provided on a flat surface on the pressing roller 25 side while extending in a longitudinal direction Y perpendicular to the recording material feeding direction X. With an outer peripheral surface of the holder 22 supporting the heater 21, the film 24 is externally fitted loosely. On a flat surface of the holder 22 on a side opposite from the pressing roller 25, a metal stay 23 for providing the holder 22 with strength along the longitudinal direction Y perpendicular to the recording material feeding direction X is provided.

As described above, the holder 22 is a heat-insulating member for not only supporting the heater 21 but also preventing heat distribution in a direction opposite to the nip N, and is formed of a liquid crystal polymer, a phenolic resin, polyphenylene sulfide (PPS), polyether ether ketone (PEEK), or the like.

In this embodiment, as the holder 22, a holder using the liquid crystal polymer as a material thereof and having a heat-resistant temperature 260° C. and a thermal expansion coefficient of $6.4\times10^{-5}$ was used.

Hearer 21

The heater 21 includes an elongated substrate 21*a* formed of alumina or aluminum nitride. On a surface of the substrate 21*a* on the pressing roller 25 side, a heat generating resistor layer 21*b*, as a heat generating resistor generating heat by energization, is provided along the longitudinal direction of the substrate 21*a*. Further, in order to realize insulation and improvement of an anti-wearing property of the heat generating resistor layer 21*b*, the heat generating resistor layer 21*b* is coated with a glass layer 21*c* as a protective layer.

In this embodiment, alumina was used as a material of the substrate 21*a* of the heater 21. The substrate 21*a* has a dimension such that a width with respect to the recording material feeding direction X is 6.0 mm, a length with respect to the longitudinal direction Y perpendicular to the recording material feeding direction X is 260.0 mm, and a thickness with respect to a recording material thickness direction Z is 1.0 mm, and has a thermal expansion coefficient of $7.6\times10^{-6}$/° C. The heat generating resistor layer 21*b* is formed of silver-palladium alloy and is 20Ω in total resistance and 700 ppm/° C. in temperature dependency of resistance. The glass layer 21*c* is 1.0 W/m·K in thermal conductivity, 2.5 KV or more in pressure resistance and 70 μm in film thickness.

Pressing Roller 25

The pressing roller 25 includes a metal core 25*a* of iron, or the like, an elastic layer 25*b* provided on an outer peripheral surface of the metal core 25*a*, and a parting layer 25*c* provided on an outer peripheral surface of the elastic layer 25*b*. As the elastic layer 25*b*, a layer of foamed heat-resistant rubber, such as insulating silicone rubber or fluorine-containing rubber, is used. Further, onto the outer peripheral surface of the elastic layer 25*b*, as an adhesive layer, a room-temperature-vulcanizing (RTV) silicone rubber, which has an adhesive property by being subjected to primer treatment, is applied, and thereon, as the parting layer 25*c*, a tube containing an electroconductive agent, such as carbon black dispersed in PFA, PTFE, FEP, or the like, is formed by coating or application.

In this embodiment, the pressing roller 25 having a roller outer diameter of 20 mm and a roller hardness of 48° (Asker-C hardness under a load of 600 g) was used.

As shown in FIG. 4, with respect to the longitudinal direction Y perpendicular to the recording material feeding direction X, by left and right frames F of the fixing device 20, both end portions of the metal core 25*a* of the pressing roller 25 are rotatably supported through bearing B. Further, by the left and right frames F, both end portions of the holder 22 and the stay 23 are supported.

Both end portions of the stay 23 are pressed in a direction (recording material thickness direction Z) perpendicular to a generatrix direction of the film 24 with a load of 147 N (15 kgf) by pressing springs 27. By this pressing force (pressure), the holder 22 presses the heater 21 against the inner peripheral surface (inner surface) of the film 24, so that the outer peripheral surface of the film 24 is press-contacted to an outer peripheral surface of the pressing roller 25. As a result, the elastic layer 25*b* of the pressing roller 25 is deformed by elastic deformation, so that the nip N having a predetermined width with respect to the recording material feeding direction X is formed by the pressing roller surface and the film surface.

Heat-Fixing Process Operation

When a motor M (FIG. 4) is rotationally driven by the fixing controller 320 of FIG. 2, rotation (rotational force) of the motor M is transmitted to a gear G provided at one end portion of the metal core 25*a* of the pressing roller 25, and, as a result, the pressing roller 25 is rotated in an arrow direction of FIG. 3. The film 24 is rotated in an arrow direction of FIG. 3 by following rotation of the pressing roller 25, while the inner surface thereof slides on the glass layer 21*c* of the heater 21.

When electrical power is supplied from a power source (not shown) to the heat generating resister layer 21*b* by the fixing controller 320, the heat generating resistor layer 21*b* generates heat, so that the heater 21 is abruptly increased in temperature. On the basis of a detection temperature output from a thermistor (temperature detecting means) 26 (FIG. 3) for detecting a temperature of the heater 21, the fixing controller 320 controls an amount of electrical power supply (amount of energization) to the heater 21 so that the temperature of the heater 21 is maintained at a predetermined fixing temperature (target temperature, hereafter referred to as a control temperature).

The transfer material P carrying thereon the unfixed toner image t is heated while being nipped and fed through the nip N, whereby the toner image is fixed on the recording material.

Fixing Controller 320

In FIG. 2, the fixing controller 320 is operated in accordance with a temperature control program stored in the ROM 312. The fixing controller 320 carries out control in which, on the basis of the detection temperature of the thermistor 26, the temperature of the heater 21 is maintained at a predetermined control temperature necessary to fix the toner image.

As a control method, proportional-integral-derivation control using a proportional term, an integral term and a differential term may preferably be used. A control formula is shown below:

$$f(t)=\alpha 1\times e(t)+\alpha 2\times e(t)+\alpha 3\times(e(t)-e(t-1)) \quad \text{formula 1,}$$

where t is a control timing, f(t) is a heater energization time ratio in control period at a timing t (full turning-on of heater at heat energization time ratio of 1 or more), e(t) is a temperature difference between a target temperature and an actual temperature at a current control timing t, e(t)(1) is a temperature difference between the target temperature and the actual temperature at a last control timing (t−1), α1 to α3 are gain constants, and, more specifically, α1 is a proportional (P), α2 is an integral (I) term gain, and α3 is a differential (D) term gain.

In formula 1, the target temperature refers to a control temperature necessary to fix the toner image t on the transfer material P, and the actual temperature refers to a detection temperature of the thermistor 26.

In formula 1, e(t) of the second term of the right on the right side corresponds to proportional control, Σe(t) of the fourth term on the right side corresponds to integral control, and (e(t)−e(t−1)) of the sixth term on the right side corresponds to differential control. Here, α1, α2 and α3 are proportional coefficients for performing weighting for an increased/decreased amount of the heater energization time ratio in the control period. By setting α1 to α2 depending on a characteristic of the fixing device 20, optimum temperature control can be carried out. The heater energization time in the control period is determined depending on a value of f(t) and an unshown heater energization time control circuit is driven, so that electrical power supplied to the heater 21 is determined.

Incidentally, control in which α3, which is the D term gain, is set at 0 and thus, only the P term and the I term function are used, is referred to as proportional integral (PI) control, and, when the D term is not needed, the temperature of the heater 21 may also be controlled by the PI control.

In this embodiment, the control timing was renewed with an interval of 100 msec in control period. The P term gain (α1) was renewed with an interval of 0.05° $C.^{-1}$, the I term gain (α2) was renewed with an interval of 0.01° $C.^{-1}$, and the D term gain (α3) was renewed with an interval of 0.001° $C.^{-1}$. By a setting such that the energization time in the control period is maximum when the f(t) value is 1 and such that, when a calculation result is greater than 1, energization is performed for a maximum energization time in the control period.

In the fixing controller 320, all or either of the P term gain, the I term gain, and the D term gain of the PID control or the P term gain and the I term gain PI control may also be changed depending on the detection temperature. Further, in the fixing controller 320, a calculation value of the integral control of the PID control or the PI control may also be changed depending on the above-described detection temperature.

Figure 5:
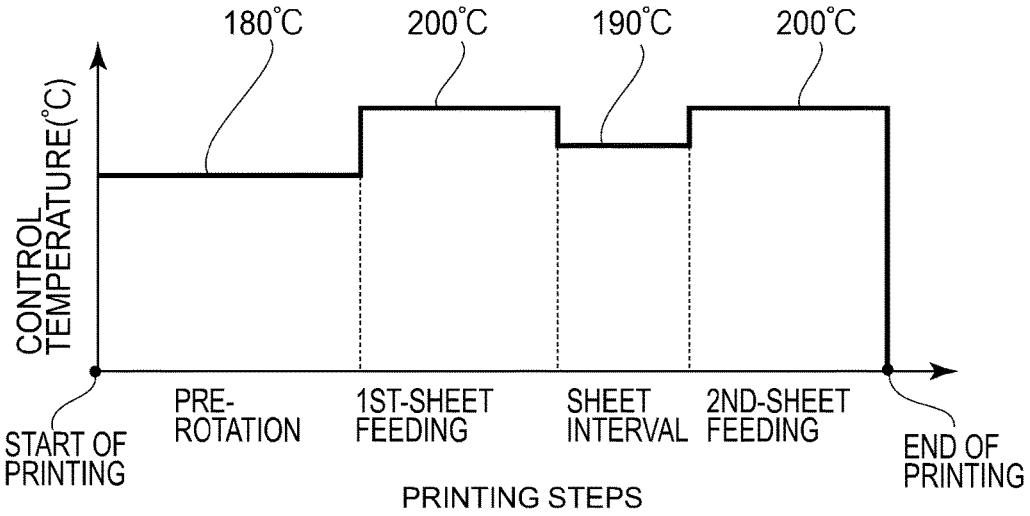
FIG. 5 is a schematic view for illustrating a temperature control sequence in Embodiment 1.

Further, the fixing controller 320 sets the control temperature of the fixing device 20 correspondingly to a printing operation step of the image forming apparatus 100 by using a temperature control sequence shown in FIG. 5. In FIG. 5, the abscissa represents the printing operation step, and the ordinate is the control temperature (° C.) set correspondingly to the printing operation step.

In a case in which toner images are continuously printed on the transfer materials P, as shown in FIG. 5, during pre-rotation (in a period from a start of a printing operation until a transfer material leading end of a first sheet enters the nip N) is set at 180° C. Here, the pre-rotation refers to rotation of the pressing roller 25 and the film 24 for a predetermined time before the heat-fixing process operation is started.

During transfer material feeding of the first sheet (in a period from arrival of the transfer material leading end of the first sheet at the nip N until a transfer material trailing end of the first sheet passes through the nip N) is set at 200° C.

During a transfer material interval (in a period from passing of the transfer material trailing end of the first sheet through the nip N until a transfer material leading end of a second sheet reaches the nip N) is set at 190° C.

The above-described control temperatures are temperatures set so that an image of black printed on an entire (whole) surface of the sheet (transfer material P) (i.e., a solid black print image (on the entire surface)) can be fixed on the transfer material P.

Image Processing Portion 303

The image processing portion 303 shown in FIG. 2 includes an image detecting portion 401 as an image detecting means, a control temperature correction amount changing portion 402 as a correction amount calculating means (correction amount acquiring means), and a print image processing portion 403 as a print image processing means.

The CPU 311 (control means) analyzes whether or not a plurality of pixels, of image data corresponding to the image to be formed on the transfer material (recording material) P, in each interval corresponding to a circumferential length of the film 24 (heat transfer member) with respect to a transfer material (recording material) feeding direction are pixels for forming an image with a predetermined density or more. Then, depending on an analyzation result, the CPU 311 sets the control temperature (target temperature) of the ceramic heater 21 (heating member).

The CPU 311 sets the control temperature at a first temperature when the number of pixels for forming the image with the predetermined density or more is a first number and sets the control temperature at a second temperature greater than the first temperature when the number of pixels for forming the image with the predetermined density or more is a second number that is greater than the first number.

On the basis of the image data bitmapped by the print image processing portion 403 (print image processing means) 403, the CPU 311 analyzes whether or not the plurality of pixels in each interval corresponding to the circumferential length of the film 24 with respect to the transfer material feeding direction are the pixels for forming the image with the predetermined density or more.

The image detecting portion (image detecting means) 401 divides the above-described image data into a plurality of regions with respect to a direction perpendicular to the transfer material feeding direction and calculates the number of pixels for forming the image with the predetermined density or more in each of the plurality of divided regions, and thus, calculates a maximum pixel number. The CPU 311 sets the control temperature on the basis of the calculated maximum pixel number.

In the following, a description of a print image processing portion 403 will be made specifically.

Print Image Processing Portion 403

On the basis of a print instruction from the host computer 300, or the like, connected with the printer through an unshown network, or the like, the print image processing portion 403 performs a print image processing for converting the image data into bitmap data capable of being output by the printer.

In general, the print image processing portion 403 receives data of characters, graphics and image objects, and subjects the received data to bitmap processing, screen processing, and density correction processing.

In the image forming apparatus of this embodiment, the above-described processing was carried out at a resolution of 600 dpi.

Image Detecting Portion 401

Figure 6:
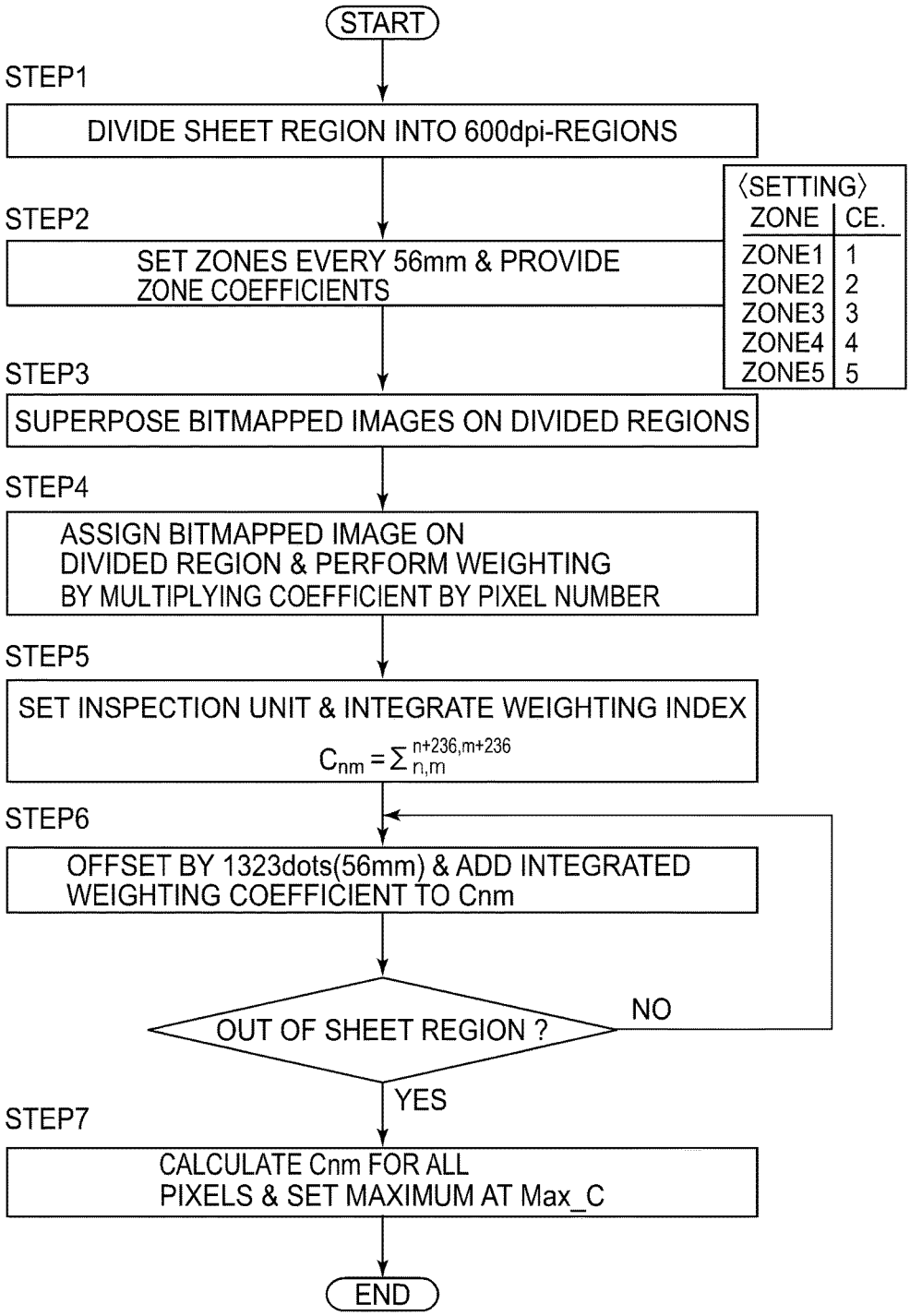
FIG. 6 is a flowchart showing a procedure for calculating a fixing pixel count in Embodiment 1.
Figure 7:
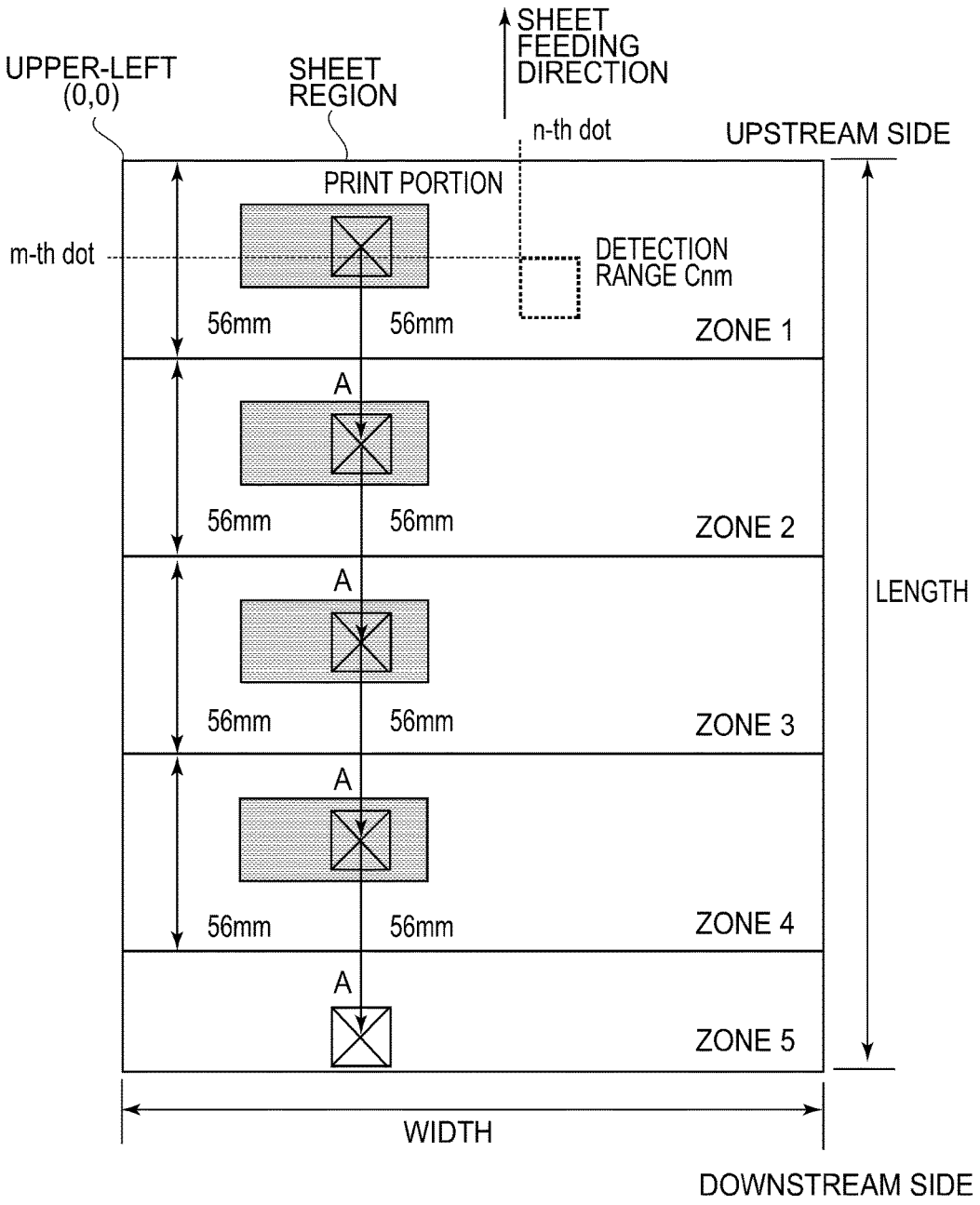
FIG. 7 is a schematic view showing contents of a process of the flowchart of FIG. 6.

The image detecting portion 401 performs a processing for calculating a fixing pixel count correlating with the control temperature with respect to the toner image necessary to correct the control temperature. A calculating method (acquiring method) of the fixing pixel count will be described with reference to FIGS. 6 and 7. FIG. 6 is a flowchart showing a procedure for calculating the fixing pixel count. FIG. 7 is a schematic view showing contents of the process of the flowchart shown in FIG. 6.

The calculating method of the fixing pixel count shown in FIG. 6 will be described.

Step 1

As region of a transfer material subjected to printing in which a position corresponding to a transfer material leading end (an upper-left end of the transfer material of FIG. 7) is a leading end, and which has a length and a width of the transfer material to be subjected to printing, is defined as a transfer material region (recording material region) (FIG. 7), and the transfer material region has a resolution of 600 dpi.

Step 2

A plurality of zones are set in the region defined in step 1 so that the zones are started from the transfer material leading end and each of the zones has a length of 56 mm equal to one rotation period of the film 24. As a result, grouping of the zones is represented as shown in the schematic view of FIG. 7. A zone coefficient for calculating fixing pixels for each of the zones was provided. The zone coefficient for each of the zones is defined as shown in Table 1.

TABLE 1

| Zone | Coefficient |
|---|---|
| 1 | 1 |
| 2 | 2 |
| 3 | 3 |
| 4 | 4 |
| 5 | 5 |

Step 3

The image bitmapped to 600 dpi by the print image processing portion 403 is superposed on the transfer material region defined in step 1. Position coordinates of each pixel of the bitmapped image are represented by (n, m).

Step 4

Each experiment of the bitmapped image is assigned to the zone set in step 2, and the number of pixels of a printing portion (FIG. 7) is multiplied by the zone coefficient, so that each pixel is subjected to weighting (formula 2 below). As a fixing weighting index for each pixel, a value 1 of the zone coefficient is set for printing portion dots and a value 0 of the zone coefficient is set for non-printing-portion dots (formula 3 below):

$$\text{Fixing weighting index}(n,m)=\text{zone coefficient}\times f(n,m) \quad \text{formula 2, and}$$

$$f(n,m)=\begin{cases}\text{printing portion dots: } 1\\ \text{non-printing portion dots: } 0\end{cases}. \quad \text{formula 3}$$

Step 5

An inspection range (square region indicated by a broken line) of 236 dots (10 mm)×236 dots (10 mm) is set by taking the upper-left end of the transfer material (FIG. 7) as a starting point, and the sum of values of the fixing weighting index is Cnm (formula 4 below). Here, the reason why the inspection range is set at 236 dots (10 mm)×236 dots (10 mm) is that a fixing property in a case in which the square printing portion having a size equal to the inspection range is repeated with one rotation period of 56 mm for the film 24 with respect to the transfer material feeding direction, and a fixing property in entire surface printing (entire print ratio: 100%) are equal to each other.

$$Cnm=\Sigma_{n,m}^{n+236,m+236}(\text{fixing weighting index}) \quad \text{formula 4.}$$

Step 6

The fixing weighting index in an inspection range offset from the inspection range defined in step 5 toward a downstream side with respect to the transfer material feeding direction by 1323 dots (56 mm) equal to the one rotation period of the film 24 is integrated and is added to Cnm. At this time, in a case in which the inspection range is not out of the associated transfer material region, the fixing weighting index in an inspection range further offset toward the downstream side with respect to the transfer material feeding direction by 1323 dots (56 mm) is integrated and is added to Cnm. This process is repeated until the inspection range is out of the associated transfer material region.

Arrows A in FIG. 7 schematically showing the process in which the inspection range is repetitively shifted toward the downstream side with respect to the transfer material feeding direction by 1323 dots (56 mm).

Step 7

Values of Cnm for all position coordinates (n, m) of the respective pixels subjected to the processes from step 1 to step 6 are calculated, and a maximum of Cnm is set at a fixing pixel count (Max_C) of the detected image. That is, as regards the detected image, the fixing pixel count (Max_C) refers to a maximum number of pixels with respect to the recording material feeding direction.

Control Temperature Correction Amount Calculating Portion 402

On the basis of the above-described fixing pixel count (Max_C), the correction amount calculating portion 402 performs a process for calculating a correction amount of a control temperature necessary to fix the detected image. A calculating method of a control temperature correction amount will be described. In this embodiment, the calculating method will be described using an A4 size as a size of the transfer material P as an example. As regards sizes other than the A4 size, a calculating formula may preferably be determined depending on a fixing performance of a transfer material size.

In this embodiment, the control temperature correction amount (TA) is calculated by the following calculating formula.

$$TA=INT(2.39e^{-5}\times(Max_C-835440)) \quad \text{formula 5.}$$

In formula 5, the coefficient of $2.39e^{-5}$ is derived in the following manner. A temperature difference of 20° C. between a control temperature of 200° C., during transfer material feeding, necessary to satisfactorily maintain a fixing property of an entire surface solid back print image and a control temperature of 180° C., at which a character image with a low print ratio can be fixed, is divided by a value of 835440, which is (Max_C) when the image printed on an entire surface of the A4-size sheet.

In the correction amount calculating portion 402, the control temperature correction amount TA is made to be greater with an increasing number of times of repetition of the pixel with respect to the transfer material (recording material) feeding direction. Further, in the correction amount calculating portion 402, the control temperature correction amount TA is made to be greater with a position, of the pixel repeated with respect to the transfer material feeding direction, closer to the downstream end with respect to the transfer material feeding direction. This is attributable to a greater zone coefficient with a position, of the pixel, closer to the downstream end with respect to the transfer material feeding direction (recording material feeding direction) as shown in Table 1.

Control Temperature Correction Control Process

Figure 8:
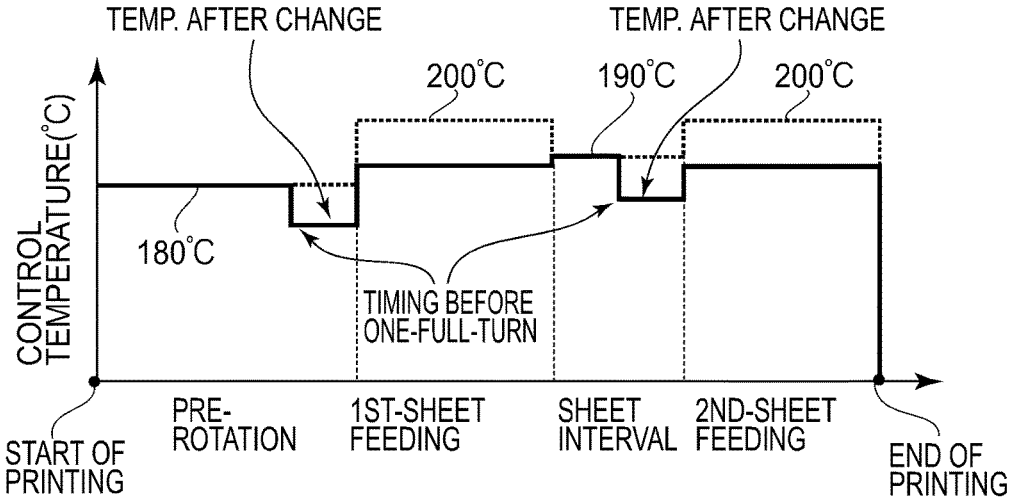
FIG. 8 is a schematic view for illustrating a temperature correction control sequence.

FIG. 8 is an illustration of a temperature correction control sequence executed by the CPU 311 of the engine controller 302.

In FIG. 8, a dotted portion corresponds to a control temperature of the temperature control sequence (FIG. 5), in which the control temperature is not corrected, and a solid line represents a control temperature changed during temperature correction in this embodiment.

In FIG. 2, when a print instruction and an image are sent from the host computer 300 to the image processing portion 303 via the interface 305, the image received by the image processing portion 303 is bitmapped by the print image processing portion 403. Then, on the basis of the bitmapped image information, the image detecting portion 401 calculates the above-described fixing pixel count Max_C. Then, the correction amount calculating portion 402 calculates a control temperature correction amount on the basis of the fixing pixel count Max_C.

The CPU 311 of the engine controller 302 starts a printing operation on the basis of the print instruction from the controller 301. At the time of the start of the printing operation, the printing operation is started at the control temperature shown in FIG. 5.

As shown in FIG. 8, at a timing (a timing before one-full-turn of the film in the figure) before one-full-turn of the film 24 with respect to the arrival of a transfer material leading end of a first sheet at the nip N, a control temperature correction amount TA corresponding to a toner image to be printed on the first sheet (transfer material) is calculated. Then, the control temperature is changed to a control temperature lower than the control temperature of 180° C. Then, the control temperature correction is ended at a timing when a transfer material trailing end passed through the nip N.

Thereafter, at a timing (a timing before one-full-turn of the film in the figure) before one-full-turn of the film 24 with respect to the arrival of a transfer material leading end of a second sheet at the nip N, a control temperature correction amount corresponding to a toner image to be printed on the second sheet (transfer material) is calculated, and the control temperature is changed to a control temperature that is less than the control temperature of 190° C.

That is, whether or not a pixel that has a predetermined density or more, and in which an interval with respect to the recording material feeding direction coincides with a circumferential length of the above-described heat transfer member, is included in an image to be formed on the recording material is detected by the image detecting portion 401. Then, in a case in which the pixel is inclined in the image, the CPU 311 sets the control temperature at a value greater than that in a case in which the pixel is not included in the image.

Description of Experiment Showing Effect of this Embodiment

A specific experiment will be described. In this experiment, in control temperature correction of image forming apparatuses of this embodiment and Comparison Examples 1 and 2, a fixing property for each of images and electrical power consumption are compared. A result of this experiment shows a result of control temperature correction made on the basis of the fixing pixel count (Max_C) of the detected image by the above-described detecting portion 401.

Comparison Example 1 is a method for determining the control temperature depending on a print ratio of an entire transfer material, in which the control temperature is not changed in entire surface printing (print ratio: 100%) and an image with an intermediary print ratio is subjected to control temperature correction of (1−(print ratio))×20° (i.e., −20° C. when the print ratio of 0).

In Comparison Example 2, in order to obtain a good fixing property irrespective of the image, the control temperature is set at a control temperature that is 20° C. greater than the control temperature (before change) at which the image can be fixed in the entire surface printing, irrespective of a kind of the image.

In this experiment, in an environment of an ambient temperature of 25° C. and a humidity of 50% relative humidity (RH), as regards each of image patterns designated below, 100 sheets on which the associated image pattern were formed were continuously passed through the nip N, and then, the fixing property for each of the images and the electrical power consumption were checked. As the sheets, A4-size sheets (CANON Red Label, basis weight: 80 g/cm$^2$) were used.

Figure 9:
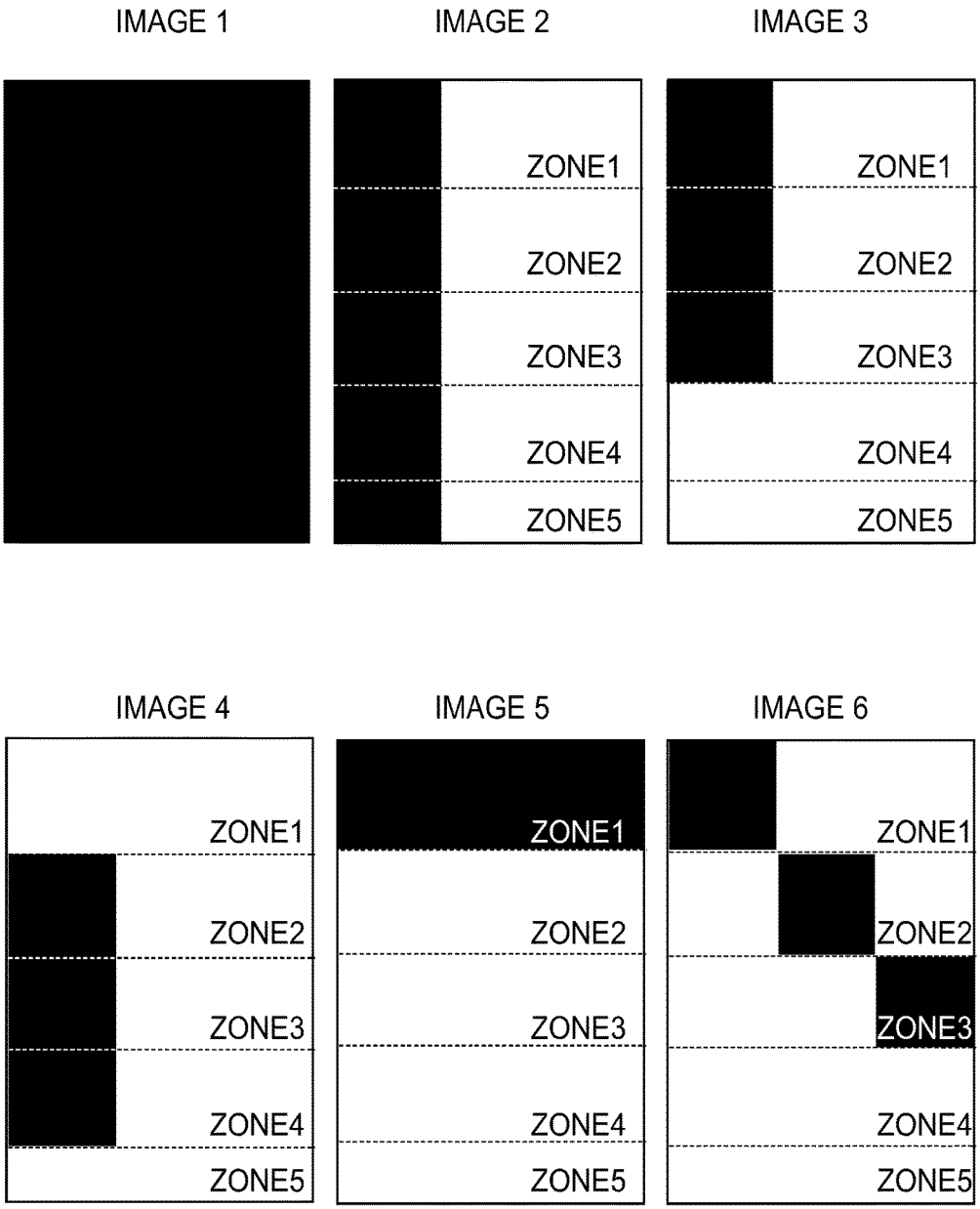
FIG. 9 is an image pattern used in an experimental example.

The image patterns used in this experiment are shown in FIG. 9.

Table 2, shown below, is a list showing features of the images of FIG. 9 used in this experiment for showing an effect of this embodiment. In Table 2, a result of calculation of the fixing pixel count from the detected image in this embodiment and a result of calculation of the control temperature correction amount on the basis of the fixing pixel count in this embodiment are shown. Further, in Table 2, a total print ratio and the control temperature correction amount in Comparison Example 1 are also shown.

TABLE 2

| IMAGE | BRIEF DESCRIPTION OF IMAGE | FIXING PIXEL COUNT | CONTROL TEMPERATURE CORRECTION AMOUNT IN EMBODIMENT 1 (° C.) | TOTAL PRINT RATIO (%) | CONTROL TEMPERATURE CORRECTION AMOUNT IN COMPARISON EXAMPLE 1 (° C.) |
|---|---|---|---|---|---|
| 1 | ENTIRE PRINTING | 835440 | 0 | 100 | 0 |
| 2 | PRINTING IN LEFT ⅓ REGION | 835440 | 0 | 33 | −13 |
| 3 | ⅔ PRINTING FROM LEADING END IN LEFT ⅓ REGION | 334176 | −12 | 20 | −16 |
| 4 | SECOND TO FOURTH FILM PERIOD PRINTING IN LEFT ⅓ REGION | 501264 | −8 | 20 | −16 |
| 5 | FIRST FILM PERIOD PRINTING IN LEFT ⅓ REGION | 55696 | −19 | 20 | −16 |
| 6 | FIRST FILM PRINTING IN LEFT ⅓ REGION SECOND FILM PERIOD PRINTING IN CENTRAL ⅓ REGION THIRD FILM PRINTING IN RIGHT ⅓ REGION | 167088 | −16 | 20 | −16 |

A calculating method of the fixing pixel count in this embodiment will be described as an example with reference to IMAGE 3 in FIG. 9.

The sheet size is A4, and IMAGE 3 is an image including a print portion having a length (56 mm×3) corresponding to 3 rotation period of the film from a sheet leading end on a left ⅓ region of the sheet.

A description will be made in accordance with a flowchart of FIG. 6.

The processes from step 1 to step 4 will be omitted, since these processes are irrespective of the kind of the image.

First, calculation is performed at upper-left coordinates (0, 0). In the inspection range defined in step 5, inspection is carried out in all of the print portion, and, therefore, C (0,0) is calculated in the following manner.

$$C(0,0)=236\times236\times1=55696 \quad \text{formula 6.}$$

Next, in step 6, the inspection range is offset toward the downstream side with respect to the sheet feeding direction and Cnm is integrated.

The sheet has an A4 size (298 mm), so that the film (56 mm) can turn through 5 full circumferences on the sheet. For that reason, the number of times of the offset of the inspection range is 4 (times). Further, on the sheet, the image having the length corresponding to the 3 rotation periods of the film is formed, and, on a side downstream of the image with respect to the sheet feeding direction, there is no image, and, therefore, integrated values of the fixing weighting index in the respective inspection ranges are as follows:

Offset(first time)=236×236×2,

Offset(second time)=236×236×3,

Offset(third time)=0×0×4, and

Offset(fourth time)=0×0×5.

Therefore, C (0,0) is calculated by the following formula 7:

$$C(0,0)=236\times236\times1+236\times236\times2+236\times236\times3+0\times0\times4+0\times0\times5=334176 \quad \text{formula 7.}$$

Next, Cnm is calculated for all the position coordinates in step 7.

In IMAGE 3, the image is continuous in the 3 rotation periods of the film from the leading end of the sheet region (i.e., the leading end of the transfer material region), so that C (0,0) subjected to integration corresponding to 3 full turns of the film (i.e., corresponding to two times of the offset) equals to a maximum (value). Therefore, the fixing pixel count (Max_C) of IMAGE 3 is 334176.

Table 3 below shows the fixing property and the electrical power consumption for each of the images in this experiment.

In Table 3, "o" of the fixing property represents a good fixing state free from lack of the image due to improper fixing, "Δ" of the fixing property represents that the lack of the image due to the improper fixing slightly occurs, and "x" represents that the lack of the image due to the improper fixing occurs.

The electrical power consumption is an integrated value of electrical power consumed by the fixing device 20 when the images are fixed on 100 sheets, on which the images are formed, continuously passed through the nip N in this experiment. As regards the control temperature correction amount, the control temperature correction amount, for each of the images, acquired by the calculation thereof in this embodiment and the control temperature correction amount, for each of the images, acquired by the calculation thereof in Comparison Example 1 are shown.

As a result, the electrical power consumption of the fixing device 20 was capable of being minimized.

TABLE 3

| | EMBODIMENT 1 | | | COMPARISON EXAMPLE 1 (CORRECTED BASED ON PRINT RATIO) | | | COMPARISON EXAMPLE 2 (NO CORRECTION) | |
|---|---|---|---|---|---|---|---|---|
| IMAGE | FIXING PROPERTY | ELECTRIC POWER CONSUMPTION (Wh) | CONTROL TEMPERATURE CORRECTION AMOUNT (° C.) | FIXING PROPERTY | ELECTRIC POWER CONSUMPTION (Wh) | CONTROL TEMPERATURE CORRECTION AMOUNT (° C.) | FIXING PROPERTY | ELECTRIC POWER CONSUMPTION (Wh) |
| 1 | ○ | 28.3 | 0 | ○ | 28.3 | 0 | ○ | 28.3 |
| 2 | ○ | 28.3 | 0 | X | 26.5 | −13 | ○ | 28.3 |
| 3 | ○ | 26.7 | −12 | X | 26.1 | −16 | ○ | 28.3 |
| 4 | ○ | 27.2 | −8 | X | 26.1 | −16 | ○ | 28.3 |
| 5 | ○ | 25.7 | −19 | ○ | 26.1 | −16 | ○ | 28.3 |
| 6 | ○ | 26.1 | −16 | ○ | 26.1 | −16 | ○ | 28.3 |

An effect of the image forming apparatus 100 of this embodiment will be described. In the image forming apparatus 100 in this embodiment, the fixing pixel count is calculated from the image detection result and the control temperature correction is performed corresponding to the fixing pixel count, and, therefore, the fixing property of all the images from IMAGE 1 to IMAGE 6 is good.

As regards IMAGE 1, the entire surface printing is carried out, so that the pixels of the printing portion are repeated in conformity to the rotation period of the film, and, therefore, the film temperature was lowered due to thermal capacity of the toner compared with the film temperature at the pixel portion in which the image was not printed. Due to this temperature lowering, the control temperature correction based on the detected image in this embodiment was performed, and the control temperature was not changed. As a result, as regards IMAGE 1, setting of the control temperature at which the image printed on the entire surface can be fixed on the sheet is ensured, and, therefore, the fixing property was good.

As regards from IMAGE 2 to IMAGE 6, there are non-printing portions at rotation period positions of the film, and, therefore, the fixing can be carried out even at the control temperature that is less than the control temperature of an initial setting. Therefore, the fixing pixel count was calculated from the image detection result and the control temperature correction was carried out correspondingly to the fixing pixel count, so that the control temperature was properly lowered (changed). As a result, the electrical power consumption was lowered compared with the case of IMAGE 1, while satisfactorily maintaining the fixing property. Particularly, as regards IMAGE 5, the electrical power consumption was made 25.7 Wh, which was smallest power consumption.

As regards IMAGE 5, as shown in FIG. 9, the pixels of the printing portion are present only in Zone 1 corresponding to one-full-turn of the film, and, therefore, the lowering in film temperature due to repetition of the printing portion with the film rotation period does not occur. Further, the position of the printing portion is on the leading end side of the sheet, and, therefore, a situation such that the lowering in film transfer material by the sheet also does not occur occurs, and, therefore, the image with a good fixing property is obtained. Therefore, the control temperature correction amount based on the image detection result in this embodiment was also set at a small value. As a result, the control temperature after the correction was lowest among the control temperatures for the images used in this experiment.

On the other hand, as regards IMAGES 1 and 2, for which the control temperature correction amount is greatest, the electrical power consumption was greatest, i.e., 28.3 Wh. Therefore, in this embodiment, by correcting the control temperature in conformity to IMAGE 5, which is the image with the good fixing property, it became possible to save energy by about 9% compared with the cases of IMAGES 1 and 2, for which the electrical power consumption is greatest.

Next, Comparison Example 1 will be described.

In Comparison Example 1, the control temperature correction is performed on the basis of the total print ratio of the image, and, therefore, the control temperature correction amount does not coincide with the fixing property of the image pattern in some cases.

As regards IMAGE 2, the image is printed on the left ⅓ portion of the sheet, and, therefore, the print ratio of the image is 33%. The image on the left ⅓ portion, however, continues from the leading end to the trailing end of the sheet with respect to the sheet feeding direction, and, therefore, the fixing property of this image pattern is the same as that in the entire surface printing. By the control temperature correction, however, the control temperature was lowered by 13° C., and, therefore, the improper fixing occurred.

Similarly, as regards IMAGES 3 and 4, the image is continuous in the sheet feeding direction, and, therefore, the image is printed with the film rotation period with respect to the sheet feeding direction. Therefore, the image pattern is poor in fixing property. When the control temperature was corrected on the basis of the print ratio, however, the improper fixing occurred since the control temperature correction amount was excessively large.

On the other hand, IMAGE 5 is the image pattern with a good fixing property since there is no repetition of the film rotation period and the image is formed at the sheet leading end portion where the film temperature is not taken (lowered) by the sheet. In Comparison Example 1, however, the control temperature is corrected depending on the print ratio, and, therefore, the control temperature is set at a value greater than the control temperature necessary to fix the image. Therefore, the electrical power consumption was 26.1 Wh greater than 25.7 Wh in this embodiment, so that an energy saving property was impaired by about 2% compared with this embodiment (Embodiment 1).

As regards IMAGE 6, the control temperature correction amount in Comparison Example 1 and the control temperature correction amount in this embodiment were equal to each other, and, therefore, not only the fixing device but also the electrical power consumption in Comparison Example 1 were the same as those in this embodiment (Embodiment 1).

Next, Comparison Example 2 will be described.

In Comparison Example 2, the control temperature correction was not performed irrespective of the image patterns, and, therefore, the fixing property was good for all the images from IMAGE 1 to IMAGE 6. Even when the sheets, on which the image pattern, such as IMAGE 5, with the good fixing property was formed, were fed through the nip N, the electrical power consumption was 28.3 Wh for all the images, and, therefore, energy saving was not capable of being realized depending on the image patterns. For example, when the electrical power consumption for IMAGE 5 in Comparison Example 2 was compared with the electrical power consumption for IMAGE 6 in this embodiment, the energy (electrical power) was excessively supplied by about 9% in Comparison Example 2.

Thus, in the image forming apparatus of this embodiment, the control temperature is changed before the leading end of the transfer material, on which the image is formed, with respect to the transfer material feeding direction reaches the nip, and, therefore, an optimum control temperature depending on the image pattern can be obtained. As a result, an effect such that not only the good fixing property is obtained, but also unnecessary electrical power consumption is suppressed and thus, an excellent energy saving property is achieved.

Embodiment 2

In an image forming apparatus used in this embodiment, constituent elements similar to those in Embodiment 1 are represented by the same reference numerals or symbols and will be omitted from description.

In Embodiment 1, control in which a printing mode of the transfer material (recording material) P is one-side printing (first printing mode), in which only the transfer material P that has not yet passed through the fixing device (fixing portion) is subjected to fixing of the image, is carried out. In this embodiment, control in which the printing mode of the transfer material P is double-side printing (second printing mode), in which the transfer materials including the transfer material that has already passed through the fixing device, is carried out.

In this embodiment, during double-sided printing, in a case in which the image is formed on a second side (surface) of the transfer material P that has passed once through the fixing device, the following control is carried out. That is, analyzation of print ratio information repeated with each of a fixing film rotation period and a pressing roller rotation period is performed on the basis of image information on a first side (surface) of the transfer material P, which has already been subjected to printing of the image, and which opposes the pressing roller 25 side, in addition to image information on the second side of the transfer material P, which is subjected to the printing of the image, and which opposes the film 24 side, is carried out. Then, the control temperature is changed.

The CPU 311 (control means) controls the image forming apparatus 100 so that image formation is carried out in an operation in the first mode, in which the image is formed on one side of the transfer material P, or in an operation in the second mode, in which the images are formed on double (both) sides of the transfer material P, and carries out the following control in a case in which the image is formed in the operation in the second printing mode. That is, the CPU 311 analyzes whether or not a plurality of pixels, of the image that has already been formed on the side of the transfer material P opposing the pressing roller 25, in each interval corresponding to a circumferential length of the pressing roller 25, with respect to a transfer material (recording material) feeding direction, are pixels for forming an image with a predetermined density or more. Then, depending on an analyzation result, the CPU 311 sets the control temperature (target temperature) of the heater 21.

The CPU 311 sets the target temperature at a third temperature when the number of pixels for forming the image with the predetermined density or more is a third number, and sets the control temperature of the heater 21 at a fourth temperature greater than the third temperature when the number of pixels for forming the image with the predetermined density or more is a fourth number that is greater than the third number.

In the following, a description will be made specifically.

Operation in Embodiment 2

As regards an application range of this embodiment, the time of image formation is the time of image formation on the second side during double-sided printing, and a method of determining the control temperature from the image information during image formation on the first side is the same as that in Embodiment 1.

An operation in this embodiment at that time of image formation on the second side during double-sided printing will be described using FIGS. 10 and 11.

Figure 10:
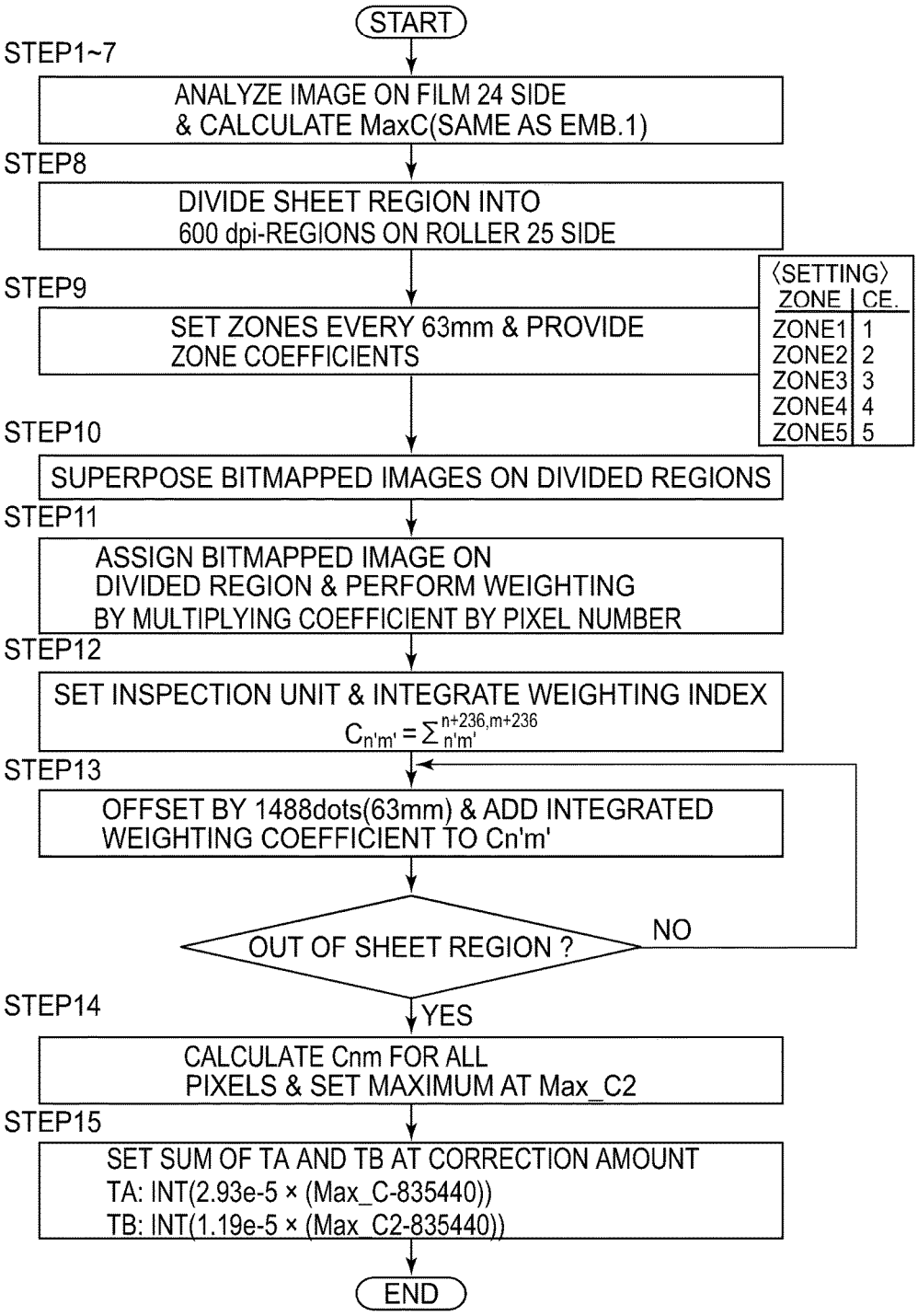
FIG. 10 is a flowchart showing a procedure for calculating a fixing pixel count in Embodiment 2.

FIG. 10 is a flowchart of an operation, which is a feature of this embodiment, in which, in addition to calculation of the fixing pixel count for the image printed on the film 24 side, the fixing pixel count for the image on the first side printed on the pressing roller 25 side is calculated, and then, the control temperature correction amount is calculated. FIG. 11 is a schematic view showing contents of processes of surfaces 8 to 14.

Steps 1 to 7

A fixing pixel counting method on the film 24 side at the time of image formation on the second side of the sheet during double-sided printing is similar to that in Embodiment 1, and, therefore, will be omitted from detailed description.

Step 8

As region of a transfer material P subjected to printing, in which a position corresponding to a transfer material P leading end (an upper-left end of the transfer materials of FIG. 11) on the pressing roller 25 side is a leading end, and which has a length and a width of the transfer materials to be subjected to printing, is defined as a transfer material region (recording material region) (FIG. 11), and the transfer material region has a resolution of 600 dpi.

Step 9

A plurality of zones are set in the region defined in step 1 so that the zones are started from the transfer material P leading end, and each of the zones has a length of 63 mm equal to one rotation period of the pressing roller 25. As a result, grouping of the zones is represented as shown in the schematic view of FIG. 11. A zone coefficient for calculating fixing pixels for each of the zones was provided. The zone coefficient for each of the zones is defined as shown in Table 4.

TABLE 4

| Zone | Coefficient |
|---|---|
| 1 | 1 |
| 2 | 2 |
| 3 | 3 |
| 4 | 4 |
| 5 | 5 |

Step 10

The image bitmapped to 600 dpi by the print image processing portion 403 is superposed on the transfer material region defined in step 8. Position coordinates of each pixel of the bitmapped image are represented by (n, m).

Step 11

Each experiment of the bitmapped image is assigned to the zone set in step 9, and the number of pixels of a printing portion (FIG. 11) is multiplied by the zone coefficient, so that each pixel is subjected to weighting (formula 8 below). As a fixing weighting index for each pixel, a value 1 of the zone coefficient is set for printing portion dots and a value 0 of the zone coefficient is set for non-printing-portion dots (formula 9 below).

$$\text{Fixing weighting index}(n',m') = \text{zone coefficient} \times f(n',m') \quad \text{formula 8.}$$

$$f(n',m') = \begin{cases} \text{printing portion dots: } 1 \\ \text{non-printing portion dots: } 0 \end{cases}. \quad \text{formula 9}$$

Step 12

An inspection range (square region indicated by a broken line) of 236 dots (10 mm)×236 dots (10 mm) is set by taking the upper-left end of the transfer material P (FIG. 11) as a starting point, and the sum of values of the fixing weighting index is Cn'm' (formula 10 below). Here, the reason why the inspection range is set at 236 dots (10 mm)×236 dots (10 mm) is that a fixing property in a case in which the square printing portion having a size equal to the inspection range is repeated with one rotation period of 63 mm for the pressing roller 25 with respect to the transfer material feeding direction and a fixing property in entire surface printing (entire print ratio: 100%) are equal to each other.

$$Cn'm' = \Sigma_{n',m'}^{n+236,m+236}(\text{fixing weighting index})' \quad \text{formula 10.}$$

Step 13

The fixing weighting index in an inspection range offset from the inspection range defined in step 12 toward a downstream side with respect to the transfer material feeding direction by 1488 dots (63 mm) equal to the one rotation period of the pressing roller 25 is integrated and is added to Cn'm'. At this time, in a case in which the inspection range is not out of the associated transfer material region, the fixing weighting index in an inspection range further offset toward the downstream side with respect to the transfer material feeding direction by 1488 dots (63 mm) is integrated and is added to Cn'm'. This process is repeated until the inspection range is out of the associated transfer material region.

Figure 11:
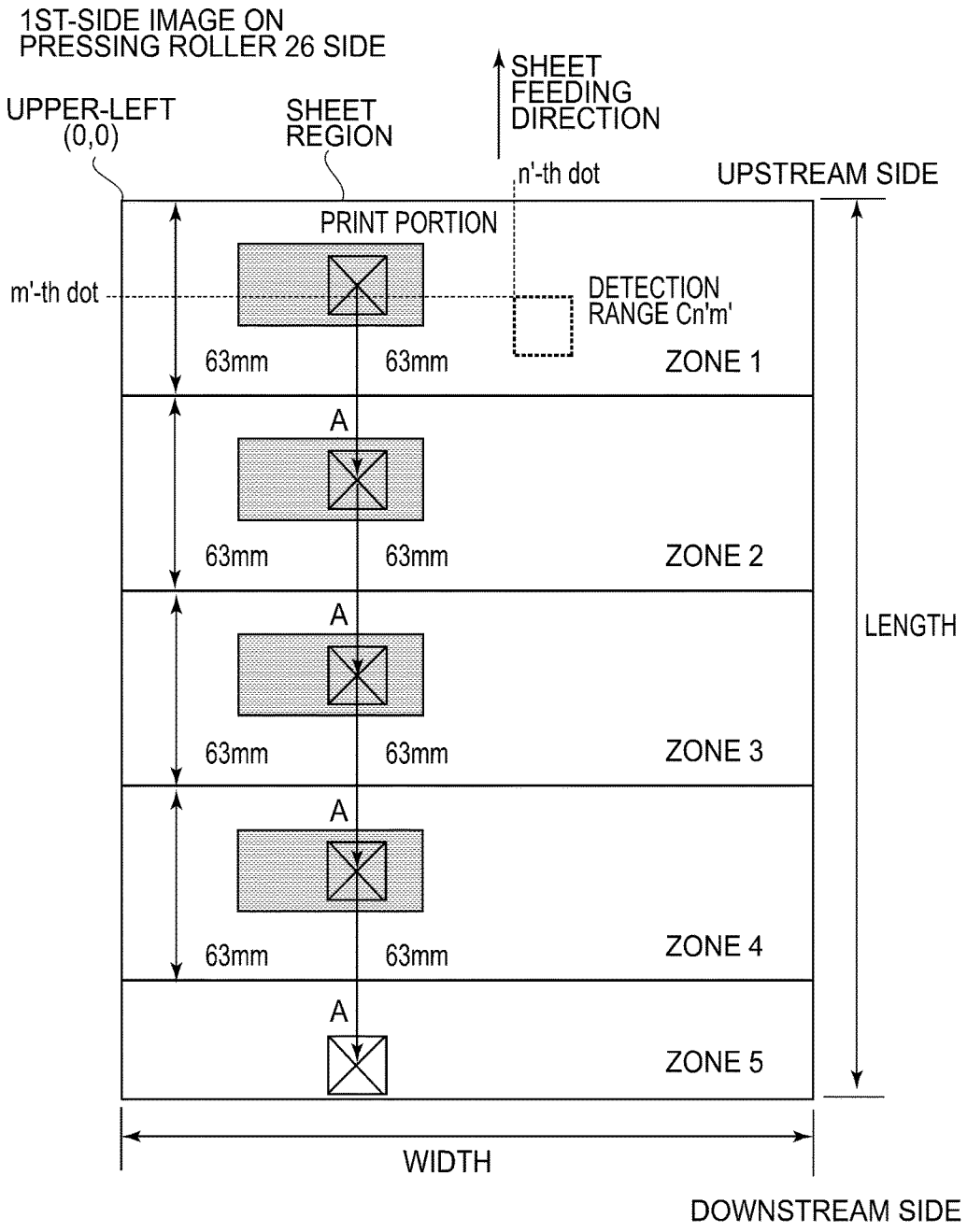
FIG. 11 is a schematic view showing contents of a process of the flowchart of FIG. 10.

Arrows A in FIG. 11 schematically show the process in which the inspection range is repetitively shifted toward the downstream side with respect to the transfer material feeding direction by 1488 dots (63 mm).

Step 14

Values of Cnm for all position coordinates (n', m') of the respective pixels subjected to the processes from step 8 to step 13 are calculated, and a maximum of Cnm is set at a fixing pixel count (Max_C2) of the detected image on the first side of the sheet on the pressing roller 25 side. That is, as regards the detected image, the fixing pixel count (Max_C2) refers to a maximum number of pixels with respect to the recording material feeding direction.

Control Temperature Correction Amount Calculating Portion 402

On the basis of the fixing pixel count (Max_C), of the detected image on the second side of the sheet on the film 24 side, acquired in surfaces 1 to 7 and the fixing pixel count (Max_C2), of the detected image on the first side of the sheet on the pressing roller 25 side, acquired in surfaces 8 to 14, the correction amount calculating portion 402 performs a process for calculating a correction amount of a control temperature necessary to fix the detected image.

A calculating method of a control temperature correction amount will be described. In this embodiment, the calculating method will be described using an A4 size as a size of the transfer material P as an example. As regards sizes other than the A4 size, a calculating formula may preferably be determined depending on a fixing performance of a transfer material size.

In this embodiment, the control temperature correction amount is calculated by the following calculating formula.

Control temperature correction amount $A$ of second-side on film 24 side TA=INT($2.39e^{-5}$×(Max_$C$-835440)), Control temperature correction amount $B$ of first-side image on pressing roller 25 control temperature TB=INT(1.19e^(−5)×(Max_$C$2-835440)), and Control temperature correction amount during printing on second side=TA+TB formula 11.

In formula 11, the coefficient $2.39e^{-5}$ is the same as that in Embodiment 1.

The coefficient of $1.19e^{-5}$ for the first-side image on the pressing roller 25 side is derived in the following manner.

A temperature difference of 10° C. between a control temperature of 190° C., at which a fixing property is satisfactorily maintained in a case in which, during double-sided printing, the first-side image is an entire surface solid back image and the second-side image is the solid black image, and a control temperature of 180° C., at which the fixing property is satisfactorily maintained in a case in which the first-side image is an entire surface solid white image and the second-side image is the solid black image is divided by a value of 835440, which is (Max_C2), when the image printed on an entire surface of the A4-size sheet.

In the correction amount calculating portion 402, the control temperature correction amount is made greater with an increasing number of times of repetition of the pixel with respect to the transfer material (recording material) feeding direction. Further, in the correction amount calculating portion 402, the control temperature correction amount is made greater with a position, of the pixel repeated with respect to the transfer material feeding direction, closer to the downstream end with respect to the transfer material feeding direction. This is attributable to a greater zone coefficient with a position, of the pixel, closer to the downstream end with respect to the transfer material feeding direction (recording material feeding direction) as shown in Table 1.

Control Temperature Correction Control Process

Figure 12:
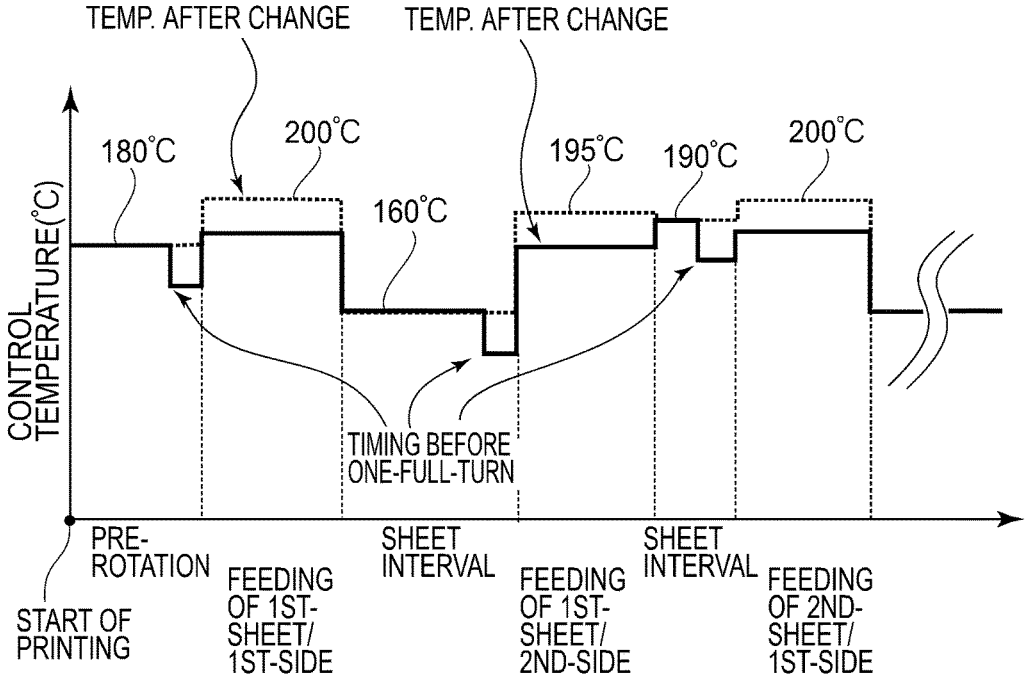
FIG. 12 is a schematic view for illustrating a temperature control sequence in Embodiment 2.

FIG. 12 is an illustration of a temperature correction control sequence executed by the CPU 311 of the engine controller 302.

In FIG. 12, a dotted portion corresponds to a control temperature of the temperature control sequence (FIG. 5) in which the control temperature is not corrected, and a solid line represents a control temperature changed during temperature correction in this embodiment.

In FIG. 2, during the second-side image formation in double side printing when a print instruction and an image are sent from the host computer 300 to the image processing portion 303 via the interface 305, the image received by the image processing portion 303 is bitmapped by the print image processing portion 403.

The image information bitmapped by the image processing portion 403 during the first-side image formation is stored as first-side image information on the pressing roller 25 side during second-side printing (image formation) in the RAM 313.

Then, during the second-side image formation, the image detecting portion 401 calculates the fixing pixel count Max_C on the basis of the bitmapped image information. In addition to this calculating process (acquiring process), on the basis of the first-side image information, which has already been bitmapped and stored in the RAM 313, the image detecting portion 401 calculates (acquires) the fixing pixel count Max_C2.

The CPU 311 of the engine controller 302 starts a printing operation on the basis of the print instruction from the controller 301. At the time of the start of the printing operation, the printing operation during double-sided printing is started at the control temperature shown in FIG. 12.

At a timing (a timing before one-full-turn of the film in the figure) before one-full-turn of the film 24 with respect to the arrival of a transfer material leading end of a first sheet at the nip N, a control temperature correction amount corresponding to a toner image to be printed on the first sheet (transfer material) is calculated, and then, is changed to a control temperature lower than the control temperature of 180° C. Then, the control temperature correction is ended at a timing when a transfer material trailing end has passed through the nip N.

The transfer material P having passed through the first-side nip N is turned upside down and fed by an unshown transfer material reversing mechanism and a feeding path for double side printing, and then, is sent again to the roller 103 and is fed to the transfer portion in which the second-side image is formed by the photosensitive drum 1 and the transfer member 5. During the process, the set temperature of the fixing device 20 can be lowered, and, therefore, the control temperature is changed to 160° C.

At a timing before one-full-turn of the film 24 with respect to arrival of a second-side leading end of the first sheet (transfer material) at the nip N, a control temperature correction amount acquired from the fixing pixel counts Max_C and Max_C2 for the image to be printed on the second-side of the first sheet is calculated, and then, the control temperature is changed to a control temperature that is less than the control temperature of 195° C. Then, at a timing when a trailing end of the second-side of the first sheet has passed through the nip N, the control temperature correction is ended.

Thereafter, at a timing (a timing before one-full-turn of the film in the figure) before one-full-turn of the film 24 with respect to the arrival of a transfer material leading end of a second sheet at the nip N, a control temperature correction amount corresponding to a toner image to be printed on the first side of the second sheet (transfer material) is calculated. Then, the control temperature is changed to a control temperature that is less than the control temperature of 190° C.

That is, whether or not a pixel, which has a predetermined density or more, and in which an interval, with respect to the recording material feeding direction, which coincides with a circumferential length of the above-described heat transfer member, is included in an image to be formed on the recording material, is detected by the image detecting portion 401. Then, in a case in which the pixel is included in the image, the CPU 311 sets the control temperature at a value greater than that in a case in which the pixel is not included in the image.

Description of Experiment Showing Effect of Embodiment 2

A specific experiment will be described. In this experiment, in control temperature correction of image forming apparatuses of this embodiment and Comparison Examples 3 and 4, a fixing property for each of images and electrical power consumption are compared.

A result of this experiment shows a result of control temperature correction made on the basis of the fixing pixel count (Max_C) of the detected second-side image on the film 24 side by the above-described detecting portion 401 and the fixing pixel count (Max_C2) of the detected first-side image on the pressing roller 25 side by the detecting portion 401.

Comparison Example 3 is a method for determining the control temperature depending on a print ratio of an entire transfer material, similarly as in Comparison Example 1, which was compared with Embodiment 1. Print ratio correction is carried out for each of the second-side image on the film 24 side and the first-side image on the pressing roller 25 side.

The control temperature is not changed in an entire surface printing (print ratio: 100%) and an image with an intermediary print ratio is subjected to control temperature correction of (1−(print ratio))×20° for the second-side image on the film 24 side and is subjected to control temperature correction of (1−(print ratio))×10° C. for the first-side image on the pressing roller 25 side.

In Comparison Example 4, in order to obtain a good fixing property irrespective of the image, the control temperature is set at a control temperature at which the image can be fixed in the entire surface printing, irrespective of a kind of the image.

For that reason, for both of the second-side image on the film 24 side and the first-side image on the detecting roller 25 side, the control temperature is set so as to satisfy the fixing property when the entire surface solid black image is printed (control temperature correction amount−0).

In this experiment, in an environment of an ambient temperature of 25° C. and a humidity of 50% RH, as regards of each of image patterns designated below, 50 sheets (100 images), on which the associated image pattern were formed, were continuously passed through the nip N in an operation in a double side printing mode, and then, the fixing property for each of the images and the electrical power consumption were checked. As the sheets, A4-size sheets (CANON Red Label, basis weight: 80 g/cm$^2$) were used.

The image patterns used in this experiment are shown in FIG. 9.

Table 5 shown below is a list of image patterns used in the experiment for showing an effect of this embodiment, a calculation result of fixing pixel counts Max_C of the second-side images on the film 24 side and control temperature correction amounts A, a calculation result of the fixing pixel counts Max_C2 of the first-side images on the pressing roller side and control temperature correction amounts B, and actual control temperature correction amounts during second-side printing.

Further, in Table 5, a total print ratio and the control temperature correction amount in Comparison Example 3 are also shown.

The images used in this experiment will be described.

IMAGE 1 and IMAGE 6 to be printed on the film 24 side during the second-side printing in the double side printing are the same as those shown in FIG. 9 used in description of Embodiment 1. In this experiment, as the second-side images on the film 24 side, IMAGE 1 with a high print ratio and IMAGE 6 with a low print ratio were used.

As the first-side images on the pressing roller 25 side, IMAGE 1' to IMAGE 6' for which the zone intervals of IMAGE 1 to IMAGE 6, respectively, shown in FIG. 9 are changed from the film 24 rotation period (56 mm) to the pressing roller 25 rotation period (63 mm) were used.

3 rotation period of the pressing roller 25 from a sheet leading end on a left ⅓ region of the sheet.

A description will be made in accordance with a flowchart of FIG. 10.

Step 1 to step 7 are similar to those in Embodiment 1, and IMAGE 1, which is the second-side image on the film 24 side, is the entire surface solid black image with the print ratio of 100%, and the fixing pixel count Max_C is 835440.

The processes from step 8 to step 11 will be omitted since these processes are the same, irrespective of the kind of the image.

For calculation of the fixing pixel count of the first-side image on the pressing roller 25 side, first, calculation is performed at upper-left coordinates (0, 0). In the inspection range of step 12, inspection is carried out all in the print portion, and, therefore, C (0',0') is calculated in the following manner.

$$C(0',0')=236\times236\times1=55696 \quad \text{formula 12.}$$

TABLE 5

| FILM 24 SIDE IMAGE INFORMATION | | | | | PRESSING ROLLER 25 SIDE IMAGE INFORMATION | |
|---|---|---|---|---|---|---|
| | | | CONTROL TEMPERATURE CORRECTION AMOUNT B | | | |
| IMAGE | TOTAL PRINT RATIO (%) | MAX_C | EMBODIMENT 2 | COMPARISON EXAMPLE 3 | FIXING PROPERTY | TOTAL PRINT RATIO (%) |
| 1 | 100 | 835440 | 0 | 0 | 1' | 100 |
| | | | | | 2' | 33 |
| | | | | | 3' | 20 |
| | | | | | 4' | 20 |
| | | | | | 5' | 20 |
| | | | | | 6' | 20 |
| 6 | 20 | 167088 | −16 | −16 | 1' | 100 |
| | | | | | 2' | 33 |
| | | | | | 3' | 20 |
| | | | | | 4' | 20 |
| | | | | | 5' | 20 |
| | | | | | 6' | 20 |

| FILM 24 SIDE IMAGE | PRESSING ROLLER 25 SIDE IMAGE INFORMATION | | | CONTROL TEMPERATURE CORRECTION AMOUNT (° C.) DURING 2ND-SIDE PRINTING | |
|---|---|---|---|---|---|
| | | CONTROL TEMPERATURE CORRECTION AMOUNT B | | | |
| INFORMATION IMAGE | MAX_C2 | EMBODIMENT 2 | COMPARISON EXAMPLE 3 | EMBODIMENT 2 | COMPARISON EXAMPLE 3 |
| 1 | 835440 | 0 | 0 | 0 | 0 |
| | 835440 | 0 | −6 | 0 | −6 |
| | 334176 | −6 | −8 | −6 | −8 |
| | 501264 | −4 | −8 | −4 | −8 |
| | 55696 | −9 | −8 | −9 | −8 |
| | 167088 | −8 | −8 | −8 | −8 |
| 6 | 835440 | 0 | 0 | −16 | −16 |
| | 835440 | 0 | −6 | −16 | −22 |
| | 334176 | −6 | −8 | −22 | −24 |
| | 501264 | −4 | −8 | −20 | −24 |
| | 55696 | −9 | −8 | −25 | −24 |
| | 167088 | −8 | −8 | −24 | −24 |

A calculating method of the fixing pixel count Max_C of the second-side image on the film 24 side for each of the respective images and the fixing pixel count Max_C2 of the first-side image on the pressing roller 25 side for each of the respective images will be described using a case in which the first-side image on the pressing roller 25 side is IMAGE 3'.

The sheet size is A4, and IMAGE 3' is an image including a print portion having a length (63 mm×3) corresponding to Next, in step 13, the inspection range is offset toward the downstream side with respect to the sheet feeding direction, and Cnm is integrated.

The sheet has an A4 size (298 mm), so that the pressing roller 25 (63 mm) can turn through 5 full circumferences on the sheet. For that reason, the number of times of the offset of the inspection range is 4 (times). Further, on the sheet, the image having the length corresponding to the 3 rotation periods of the pressing roller 25 is formed, and on a side downstream of the image with respect to the sheet feeding direction, there is no image, and, therefore, integrated values of the fixing weighting index in the respective inspection ranges are as follows.

Offset(first time)=236×236×2

Offset(second time)=236×236×3

Offset(third time)=0×0×4

Offset(fourth time)=0×0×5

Therefore, C (0',0') is calculated by the following formula 13.

$$C(0',0')=236\times236\times1+236\times236\times2+236\times236\times3+0\times0\times4+0\times0\times5=334176 \quad \text{formula 13.}$$

Next, Cnm is calculated for all the position coordinates in step 14.

In IMAGE 3', the image is continuous in the 3 rotation periods of the pressing roller 25 from the leading end of the sheet region (i.e., the leading end of the transfer material region), so that C (0',0') subjected to integration corresponding to 3 full turns of the pressing roller 25 (i.e., corresponding to two times of the offset) equals to a maximum (value). Therefore, the fixing pixel count (Max_C2) of IMAGE 3' is 334176.

Table 6 below shows the fixing property and the electrical power consumption for each of the images in this experiment.

In Table 6, an evaluation method of the fixing property is the same as that in Embodiment 1.

The electrical power consumption is an integrated value of electrical power consumed by the fixing device when the images, which are fixed on 50 sheets, on which the images are formed in the double-side printing, are continuously passed through the nip N in this experiment. As regards the control temperature correction amount, the control temperature correction amount, for each of the images, acquired by the calculation thereof in this embodiment and the control temperature correction amount, for each of the images, acquired by the calculation thereof in Comparison Example 3 are shown.

First, a constitution of Comparison Example 4, in which the control temperature is not corrected depending on the image pattern, will be described. In the constitution of Comparison Example 4, during the second-side image formation in the double-side printing, the control temperature for the first-side image on the pressing roller 25 side is set at a control temperature on the assumption that entire surface printing is carried out. For that reason, as regards to all of IMAGE 1' to IMAGE 6' as the first-side images on the pressing roller 25 side, although the fixing property was good for IMAGE 1 and IMAGE 6 as the second-side images, the electrical power consumption was 32.3 Wh, irrespective of the kind of the image pattern, so that the energy saving property was not able to be realized.

An effect of the image forming apparatus of this embodiment will be described. In the image forming apparatus in this embodiment, during the second-side image formation in the double-side printing, the first-side images printed on the pressing roller 25 side were analyzed and the fixing pixel count was calculated from the image detection result, and the control temperature correction was performed corresponding to the fixing pixel count. For that reason, the good fixing property is obtained for both of IMAGE 1 and IMAGE 6 as the second-side images on the film 24 side in all the image patterns including IMAGE 1' to IMAGE 6' as the first-side images.

As regards IMAGE 1, the entire surface printing is carried out, so that the pixels of the printing portion are repeated in conformity to the rotation period of the pressing roller 25, and, therefore, the temperature of the pressing roller 25 was lowered due to thermal capacity of the toner compared with that at the pixel portion in which the image was not printed.

Also as regards IMAGE 2', although the entire surface printing is not carried out, analysis of the pixels of the printing portion is repeated along the longitudinal direction Y in conformity to the rotation period of the pressing roller 25 partly on a left surface, so that, similarly as in the case of IMAGE 1', due to the thermal capacity of the toner, the temperature of the pressing roller 25 was lowered compared with a pixel portion in which no printing was carried out.

TABLE 6

| IMAGE | | EMBODIMENT 2 | | | COMPARISON EXAMPLE 3 (CORRECTED BASED ON PRINT RATIO) | | | COMPARISON EXAMPLE 4 (NO CORRECTION) | | |
|---|---|---|---|---|---|---|---|---|---|---|
| 2ND SIDE | 1ST SIDE | 2ND SIDE FIXING PROPERTY | ELECTRIC POWER CONSUMPTION (Wh) | CONTROL TEMPERATURE CORRECTION AMOUNT (° C.) | 2ND SIDE FIXING PROPERTY | ELECTRIC POWER CONSUMPTION (Wh) | CONTROL TEMPERATURE CORRECTION AMOUNT (° C.) | 2ND SIDE FIXING PROPERTY | ELECTRIC POWER CONSUMPTION (Wh) | CONTROL TEMPERATURE CORRECTION AMOUNT (° C.) |
| 1 | 1' | ○ | 32.3 | 0 | ○ | 32.3 | 0 | ○ | 32.3 | 0 |
| | 2' | ○ | 32.3 | 0 | X | 31.8 | −6 | ○ | 32.3 | 0 |
| | 3' | ○ | 31.8 | −6 | Δ | 31.7 | −8 | ○ | 32.3 | 0 |
| | 4' | ○ | 32 | −4 | X | 31.7 | −8 | ○ | 32.3 | 0 |
| | 5' | ○ | 31.6 | −9 | ○ | 31.7 | −8 | ○ | 32.3 | 0 |
| | 6' | ○ | 31.7 | −8 | ○ | 31.7 | −8 | ○ | 32.3 | 0 |
| 2 | 1' | ○ | 29.8 | −16 | ○ | 29.8 | −16 | ○ | 32.3 | 0 |
| | 2' | ○ | 29.8 | −16 | X | 29.3 | −22 | ○ | 32.3 | 0 |
| | 3' | ○ | 29.3 | −22 | Δ | 29.2 | −24 | ○ | 32.3 | 0 |
| | 4' | ○ | 29.5 | −20 | X | 29.2 | −24 | ○ | 32.3 | 0 |
| | 5' | ○ | 29.1 | −25 | ○ | 29.2 | −24 | ○ | 32.3 | 0 |
| | 6' | ○ | 29.2 | −24 | ○ | 29.2 | −24 | ○ | 32.3 | 0 |

Due to this temperature lowering, as regards the first-side images on the pressing roller 25 side, the value of the fixing pixel count Max_C2 is 835440 for both of IMAGE 1' and IMAGE 2', so that the control temperature correction amount B for the first-side images on the pressing roller 25 side is 0. Accordingly, the control temperature correction amount TA for the second-side images on the film 24 side (i.e., 0° C. for IMAGE 1 and −16° C. for IMAGE 6) is the control temperature correction amount for the second-side of the sheets during double-sided printing, so that the fixing property was good.

As regards from IMAGE 3' to IMAGE 6', there are non-printing portions at rotation period positions of the pressing roller 25, and, therefore, the fixing can be carried out even at the control temperature that is less than the control temperature of initial setting. Therefore, the fixing pixel count was calculated from the first-side image detection result on the pressing roller 25 side and the control temperature correction was carried out correspondingly to the fixing pixel count, so that the control temperature was properly lowered (changed).

As a result, the electrical power consumption was able to be lowered compared with the constitution of Comparison Example 4, in which the control temperature is determined on assumption that the first-side images on the pressing roller 25 side are entire surface images, while satisfactorily maintaining the fixing property. Particularly, as regards IMAGE 5', the electrical power consumption was 31.6 Wh for IMAGE 1 as the second-side image during double-sided printing and the electrical power consumption was 29.1 Wh for IMAGE 6 as the second-side image during double-sided printing, and thus, the electrical power consumption was made lower by 2% and 10%, respectively, lower than those in the constitution in which the control temperature is not corrected depending on the image pattern, as in Comparison Example 4.

Next, Comparison Example 3 will be described. In Comparison Example 3, during the second-side image formation in the double-side printing, on the basis of the total print ratio of the image, the control temperature correction is carried out for each of the first-side images on the pressing roller 25 side in addition to the second-side images on the film 24 side. For that reason, the control temperature correction amount does not coincide with the fixing property of the image pattern in some cases.

In a case in which the first-side image on the pressing roller 25 side is IMAGE 2', the image is printed on the left ⅓ portion of the sheet, and, therefore, the print ratio of the image is 33%. The image on the left ⅓ portion continues, however, from the leading end to the trailing end of the sheet with respect to the sheet feeding direction, and, therefore, the temperature of the pressing roller 25 in the printing region is the same as that in the case of the entire surface printing. During the second-side image formation in the double-side printing, however at the print ratio of the first-side image, the control temperature was excessively lowered by 6° C. for IMAGE 1 and by 22° C. for IMAGE 6, and, therefore, the improper fixing occurred.

Similarly, as regards IMAGES 3' and 4' as the first-side images on the pressing roller 25 side, the image is continuous in the sheet feeding direction, and, therefore, the image is printed with the rotation period of the pressing roller 25 with respect to the sheet feeding direction. Therefore, although the image pattern is poor in fixing property, when the control temperature was corrected on the basis of the print ratio, the control temperature correction amount was excessively large, so that the improper fixing occurred when IMAGES 1 and 6 are printed on the second sides during double-sided printing.

On the other hand, IMAGE 5' as the first-side image on the pressing roller 25 side is the image pattern with a good fixing property, since there is no repetition of the rotation period of the pressing roller 25 and the image is formed at the sheet leading end portion where the temperature of the pressing roller 25 is not taken (lowered) by the sheet. In Comparison Example 3, however, the control temperature is corrected depending on the print ratio, and, therefore, the control temperature is set at a value greater than the control temperature necessary to fix the image. Therefore, in the case of IMAGE 1 and IMAGE 6 as the second-side images during double-sided printing, values of the electrical power consumption were 31.7 Wh and 29.2 Wh, respectively, which are greater than 31.6 Wh and 29.1 Wh in this embodiment, with the result that an energy saving property was impaired by about 1% compared with this embodiment (Embodiment 2).

Thus, in the image forming apparatus 100 in this embodiment, on the basis of the second-side image information and the image information of the image printed on the first side of the sheet during double-sided printing, analyzation of the print ratio information of the image pattern repeated with each of the rotation period of the film 24 and the rotation period of the pressing roller 25. Then, by changing the control temperature setting, an optimum control temperature depending on the image pattern can be obtained. As a result, an effect such that not only the good fixing property is obtained, but also unnecessary electrical power consumption is suppressed and thus, the energy saving property is excellent is achieved.

Other Embodiments

In the image forming apparatuses 100 in the above-described embodiments, the image forming operation may also be performed by connecting, in place of the host computer 300, a computer or print server, which is connected on a network, with the image forming apparatuses 100.

The fixing pixel counts of the images and the calculation of the control temperature correction amounts are not limited to those performed by the image processing portion 303 of the controller 301. A part or all of the fixing pixel counts of the images and the calculation of the control temperature correction amounts may also be performed by programs included in the host computer, a printer on the network, or the print server.

The inspection range set in the image detecting portion 401 is 236 dots (10 mm)×236 dots (10 mm), but the above-described embodiments are not intended to limit the region of the inspection range, but a size and a shape of the inspection range may also be changed depending on a characteristic of the image forming apparatus 100.

The control temperature correction amount calculated by the correction amount calculating portion 402 may also be changed on the basis of a fixing mode for determining the control temperature or information from a transfer material kind discriminating means, such as an unshown media sensor.

In the fixing controller 320, only the change of the control temperature was made, but a gain and an offset amount of the PID control used in the control temperature control may also be changed. Further, in the fixing controller 320, the control temperature was changed before the transfer material P subjected to image detection by the image detecting portion 401 reaches the nip N, but the control temperature may also be changed before the toner image subjected to the image detection by the image pressing portion reaches the nip N.

According to the present invention, suppression of improper fixing of the image and the energy saving property can be compatibly realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming portion configured to form an image on a recording material;

a fixing portion including a cylindrical heat transfer member, and a heating member contacting an inner surface of said heat transfer member, said fixing portion being configured to fix the image on the recording material by heating the recording material, on which the image has been formed, by heat from said heating member through said heat transfer member; and a control unit configured to control a target temperature of said heating member, wherein said control unit analyzes whether or not a plurality of pixels, of image data corresponding to the image to be formed on the recording material, in each interval corresponding to a circumferential length of said heat transfer member, with respect to a recording material feeding direction, are pixels for forming an image with a predetermined density or more, and sets the target temperature depending on an analyzation result.

2. The image forming apparatus according to claim 1, wherein said control unit sets the target temperature at a first temperature when a number of the pixels for forming the image with the predetermined density or more is a first number, and sets the target temperature at a second temperature greater than the first temperature when the number of the pixels for forming the image with the predetermined density or more is a second number is greater than the first number.

3. The image forming apparatus according to claim 1, wherein said fixing portion further includes a pressing member configured to form a nip in which said pressing member nips and feeds the recording material in cooperation with said heating member through said heat transfer member.

4. The image forming apparatus according to claim 3, wherein said control unit sets the target temperature before a leading end of the recording material, on which the image has been formed, with respect to the recording material feeding direction, reaches the nip.

5. The image forming apparatus according to claim 3, wherein said control unit controls said image forming portion so that the image is formed by one of an operation in a first printing mode, in which the image is formed on one side of the recording material, and an operation in a second printing mode, in which the image is formed on double sides of the recording material, and wherein, when the image is formed by the operation in the second printing mode, said control operation analyzes, to provide another analyzation result, whether or not a plurality of pixels, of an image that has already been printed on a side of the recording material opposing said pressing member, in each interval corresponding to a circumferential length of said pressing member, with respect to the recording material feeding direction, are pixels for forming the image with the predetermined density or more, and sets the target temperature depending on the other analyzation result.

6. The image forming apparatus according to claim 5, wherein said control unit sets the target temperature at a third temperature when the number of the pixels for forming the image with the predetermined density or more is a third number, and sets the target temperature at a fourth temperature greater than the third temperature when the number of the pixels for forming the image with the predetermined density or more is a fourth number is greater than the third number.

7. The image forming apparatus according to claim 5, wherein said control unit increases the target temperature with an increasing number of repetitions of a pixel, which is repeated with respect to the recording material feeding direction.

8. The image forming apparatus according to claim 5, wherein said control unit increases the target temperature as a pixel, which is repeated with respect to the recording material feeding direction, is positioned more on a downstream side, with respect to the recording material feeding direction.

9. The image forming apparatus according to claim 5, further comprising:

a temperature detecting unit configured to detect a temperature of said heating member; and a fixing control unit configured to control the temperature of said heating member by carrying out one of proportion-integral-derivative (PID) control using a proportional term, an integral term, and a differential term, and proportion integral (PI) control using the proportional term and the integral term, PI control on the basis of a detection temperature of said heating member detected by said temperature detecting unit, wherein said fixing control unit changes at least one of (a) at least one of (i) a proportional term gain, (ii) an integral term gain, and (iii) a differential term gain of the PID control, and (b) at least one of (i) the proportional term gain, and (ii) the integral term gain of the PI control, depending on the detection temperature.

10. The image forming apparatus according to claim 5, further comprising:

a temperature detecting unit configured to detect a temperature of said heating member; and a fixing control unit configured to control the temperature of said heating member by carrying out one of (i) proportion-integral-derivative (PID) control using a proportional term, an integral term, and a differential term, and (ii) proportion integral (PI) control using the proportional term and the integral term, on the basis of a detection temperature of said heating member detected by said temperature detecting unit, wherein said fixing control unit changes a calculation value of integral control of the one of the PID control and the PI control, depending on the detection temperature.

11. The image forming apparatus according to claim 1, further comprising a print image processing unit configured to change the image data corresponding to the image to be formed on the recording material to bitmapped image data, wherein, on the basis of the bitmapped image data, said control unit analyzes whether or not the plurality of pixels in each interval corresponding to the circumferential length of said heat transfer member, with respect to the recording material feeding direction, are the pixels for forming the image with the predetermined density or more.

12. The image forming apparatus according to claim 1, further comprising an image detecting unit configured to calculate a maximum pixel number by dividing the image data into a plurality of regions, with respect to a direction perpendicular to the recording material feeding direction, and then, by calculating a number of pixels for forming the image with the predetermined density or more in each of the plurality regions, wherein said control unit sets the target temperature on the basis of the maximum pixel number.

13. The image forming apparatus according to claim 1, wherein said control unit increases the target temperature with an increasing number of repetitions of a pixel repeated with respect to the recording material feeding direction.

14. The image forming apparatus according to claim 1, wherein said control unit increases the target temperature as a pixel, which is repeated with respect to the recording material feeding direction, is positioned more on a downstream side, with respect to the recording material feeding direction.

15. The image forming apparatus according to claim 1, further comprising:

a temperature detecting unit configured to detect a temperature of said heating member; and a fixing control unit configured to control the temperature of said heating member by carrying out one of proportion-integral-derivative (PID) control using a proportional term, an integral term, and a differential term, and proportion integral (PI) control using the proportional term and the integral term, on the basis of a detection temperature of said heating member detected by said temperature detecting unit, wherein said fixing control unit changes at least one of (a) at least one of (i) a proportional term gain, (ii) an integral term gain, and (iii) a differential term gain of the PID control, and (b) at least one of (i) the proportional term gain, and (ii) the integral term gain of the PI control, depending on the detection temperature.

16. The image forming apparatus according to claim 1, further comprising:

a temperature detecting unit configured to detect a temperature of said heating member; and a fixing control unit configured to control the temperature of said heating member by carrying out one of (i) proportion-integral-derivative (PID) control using a proportional term, an integral term, and a differential term, and (ii) proportion integral (PI) control using the proportional term and the integral term, on the basis of a detection temperature of said heating member detected by said temperature detecting unit, wherein said fixing control unit changes a calculation value of integral control of the one of the PID control and the PI control, depending on the detection temperature.

17. An image forming apparatus comprising:

an image forming portion configured to form an image on a recording material;

a fixing portion including a cylindrical heat transfer member, a heating member contacting an inner surface of said heat transfer member, and a pressing member for forming a nip, in which said pressing member nips and feeds the recording material in cooperation with said heating member through said heat transfer member, said fixing portion being configured to fix the image on the recording material by heating the recording material, on which the image has been formed, by heat from said heating member through said heat transfer member; and a control unit configured to control a target temperature of said heating member, wherein, for a plurality of pixels, of image data corresponding to the image to be formed on the recording material, in each interval corresponding to a circumferential length of said heat transfer member with respect to a recording material feeding direction, said control unit acquires a first number of pixels for forming an image with a predetermined density or more, and, for a plurality of pixels, of an image that has already been printed on a side of the recording material opposing said pressing member, in each interval corresponding to a circumferential length of said pressing member, with respect to the recording material feeding direction, said control unit acquires a second number of pixels for forming an image with a predetermined density or more, and said control unit sets the target temperature depending on the first number of pixels and the second number of pixels.

* * * * *